US008018710B2

(12) United States Patent
Fujita et al.

(10) Patent No.: US 8,018,710 B2
(45) Date of Patent: Sep. 13, 2011

(54) IONIZER AND STATIC ELIMINATION METHOD

(75) Inventors: Tsukasa Fujita, Osaka (JP); Yuuki Tokita, Osaka (JP)

(73) Assignee: Keyence Corporation, Osaka (JP)

( * ) Notice: Subject to any disclaimer, the term of this patent is extended or adjusted under 35 U.S.C. 154(b) by 210 days.

(21) Appl. No.: 12/502,555

(22) Filed: Jul. 14, 2009

(65) Prior Publication Data

US 2010/0044581 A1 Feb. 25, 2010

(30) Foreign Application Priority Data

Aug. 19, 2008 (JP) ..... 2008-210735

(51) Int. Cl.
*H05F 3/04* (2006.01)
*H01T 23/00* (2006.01)

(52) U.S. Cl. ..... 361/213; 361/231; 250/324

(58) Field of Classification Search ..... 250/423 R, 250/424, 423 F, 324; 361/213, 230–231
See application file for complete search history.

(56) References Cited

U.S. PATENT DOCUMENTS

| | | | | |
|---|---|---|---|---|
| 5,121,286 | A * | 6/1992 | Collins | 361/231 |
| 5,550,703 | A * | 8/1996 | Beyer et al. | 361/229 |
| 7,375,945 | B2 * | 5/2008 | Izumi et al. | 361/231 |
| 2007/0158578 | A1 * | 7/2007 | Vernitskiy et al. | 250/423 R |

FOREIGN PATENT DOCUMENTS

| | | | |
|---|---|---|---|
| JP | 09-017593 | | 1/1997 |
| JP | 09017593 | A * | 1/1997 |
| JP | 2003-086393 | | 3/2003 |
| JP | 2004-273293 | | 9/2004 |
| JP | 2004273293 | A * | 9/2004 |
| JP | 2004-362951 | | 12/2004 |
| JP | 2004362951 | A * | 12/2004 |
| JP | 2006-012520 | | 1/2006 |
| JP | 2006-040860 | | 2/2006 |
| JP | 2006040860 | A * | 2/2006 |
| JP | 2008-159271 | | 7/2008 |
| JP | 2008-176952 | | 7/2008 |

* cited by examiner

*Primary Examiner* — Jack Berman
*Assistant Examiner* — David E Smith
(74) *Attorney, Agent, or Firm* — Kilyk & Bowersox, P.L.L.C.

(57) ABSTRACT

The ionizer includes a nozzle having a discharge electrode for inducing corona discharge by application of high voltage to eject ions, an emission port for emitting supplied gas together with the ejected ions, and a gas channel for guiding supplied gas to the emission port. Herein, a velocity of flow of the gas immediately after emission from the emission port exceeds a velocity of sound, and a gas pressure at the emission port is not less than an atmospheric pressure. The gas channel has a throat part for narrowing the gas channel such that a channel area gradually decreases, and a ratio of the atmospheric pressure to a gas pressure at a position where the channel area does not vary, the position being located forward of the throat part, is not more than 0.528.

5 Claims, 23 Drawing Sheets

FIG. 14

| | Not more than velocity of sound | Exceeding velocity of sound Over expansion | Exceeding velocity of sound Optimum expansion | Exceeding velocity of sound Under expansion 1 | Exceeding velocity of sound Under expansion 2 |
|---|---|---|---|---|---|
| Gas supply port pressure | 0.02MPa | 0.17MPa | 0.25MPa | 0.325MPa | 0.4MPa |
| Velocity of flow of gas | 129 m/s | Not more than M1.1 | M1.2 | M1.2～1.5 | M1.7 |
| Amount of flow of gas | 1.5 L/min | 3.8 L/min | 5 L/min | 6 L/min | 7.1 L/min |
| Amount of attached foreign matters | Very large | Small | Slight | Extremely slight | Almost none |

FIG. 17A
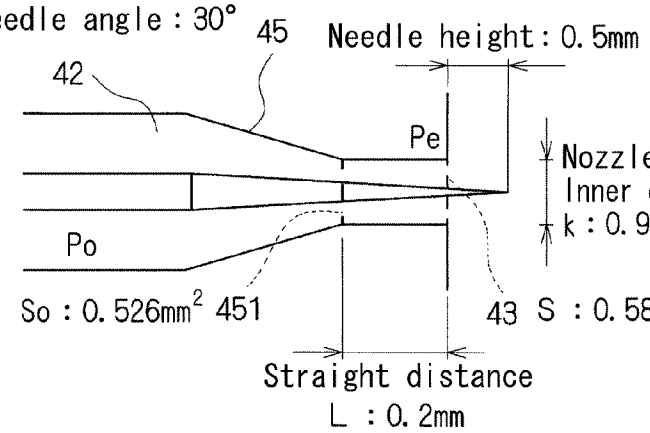
FIG. 17B
FIG. 17C
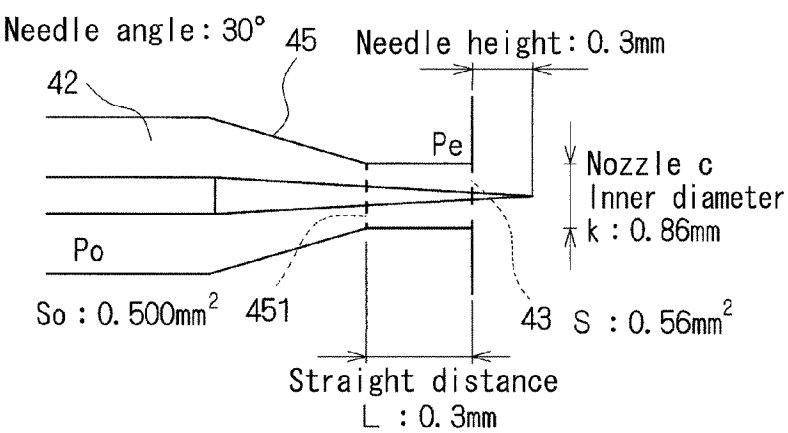
FIG. 17D

FIG. 19A

| Nozzle a | Gauge pressure Po (MPa) | Gauge pressure Pe (MPa) | Mach number at outlet M | Pe/Po | Pe (MPa) | S/So | Pa/Po |
|---|---|---|---|---|---|---|---|
| In optimum expansion status | 0.21 | 0 | 1.38 | 0.32 | 0.101 | 1.10 | 0.32 |
| In under expansion status | 0.50 | 0.09 | 1.38 | 0.32 | 0.195 | 1.10 | 0.17 |

FIG. 19B

| Nozzle b | Gauge pressure Po (MPa) | Gauge pressure Pe (MPa) | Mach number at outlet M | Pe/Po | Pe (MPa) | S/So | Pa/Po |
|---|---|---|---|---|---|---|---|
| In optimum expansion status | 0.46 | 0 | 1.78 | 0.18 | 0.101 | 1.42 | 0.18 |
| In under expansion status | 0.50 | 0.01 | 1.78 | 0.18 | 0.108 | 1.42 | 0.17 |

FIG. 19C

| Nozzle c | Gauge pressure Po (MPa) | Gauge pressure Pe (MPa) | Mach number at outlet M | Pe/Po | Pe (MPa) | S/So | Pa/Po |
|---|---|---|---|---|---|---|---|
| In optimum expansion status | 0.23 | 0 | 1.41 | 0.31 | 0.101 | 1.12 | 0.31 |
| In under expansion status | 0.50 | 0.08 | 1.41 | 0.31 | 0.186 | 1.12 | 0.17 |

FIG. 19D

| Nozzle d | Gauge pressure Po (MPa) | Gauge pressure Pe (MPa) | Mach number at outlet M | Pe/Po | Pe (MPa) | S/So | Pa/Po |
|---|---|---|---|---|---|---|---|
| In optimum expansion status | 0.14 | 0 | 1.19 | 0.42 | 0.101 | 1.03 | 0.42 |
| In under expansion status | 0.50 | 0.15 | 1.19 | 0.42 | 0.252 | 1.03 | 0.17 |

FIG. 20A

| Nozzle a | Over expansion | Optimum expansion | Under expansion |
|---|---|---|---|
| Po(Gauge pressure) | < | 0.21MPa | < |
| Pe(Gauge pressure) | < | 0.00MPa | < |
| Mach number at nozzle outlet | 1.38 | 1.38 | 1.38 |
| Mach number after nozzle outlet | Decrease | < 1.38 < | Increase |

FIG. 20B

| Nozzle b | Over expansion | Optimum expansion | Under expansion |
|---|---|---|---|
| Po(Gauge pressure) | < | 0.46MPa | < |
| Pe(Gauge pressure) | < | 0.00MPa | < |
| Mach number at nozzle outlet | 1.78 | 1.78 | 1.78 |
| Mach number after nozzle outlet | Decrease | < 1.78 < | Increase |

FIG. 20C

| Nozzle c | Over expansion | Optimum expansion | Under expansion |
|---|---|---|---|
| Po(Gauge pressure) | < | 0.23MPa | < |
| Pe(Gauge pressure) | < | 0.00MPa | < |
| Mach number at nozzle outlet | 1.41 | 1.41 | 1.41 |
| Mach number after nozzle outlet | Decrease | < 1.41 < | Increase |

FIG. 20D

| Nozzle d | Over expansion | Optimum expansion | Under expansion |
|---|---|---|---|
| Po(Gauge pressure) | < | 0.14MPa | < |
| Pe(Gauge pressure) | < | 0.00MPa | < |
| Mach number at nozzle outlet | 1.19 | 1.19 | 1.19 |
| Mach number after nozzle outlet | Decrease | < 1.19 < | Increase |

IONIZER AND STATIC ELIMINATION METHOD

CROSS-REFERENCE TO RELATED APPLICATIONS

The present application claims foreign priority based on Japanese Patent Application No. 2008-210735, filed Aug. 19, 2008, the contents of which is incorporated herein by reference.

BACKGROUND OF THE INVENTION

1. Field of the Invention

The present invention relates to an ionizer and a static elimination method for ionizing gas with ions ejected from a discharge electrode and bringing the ionized gas into contact with a target of static elimination in order to eliminate static electricity from the target.

2. Description of the Related Art

In a clean room and the like, conventionally, an ionizer has been used for preventing air from being electrically charged or eliminating static electricity from a target of static elimination. Herein, a discharge electrode induces corona discharge by application of high voltage to generate air ions. The generated air ions are brought into contact with a target of static elimination and the like, so that static electricity is eliminated from the target. Since the air ions are electrically charged, foreign matters such as dust and dirt floating in the air are also prone to be electrically charged. Consequently, the ambient foreign matters such as dust and dirt are prone to be attached to the discharge electrode.

Even when the ionizer is used in the clean room, there still remains a slight amount of foreign matters such as dust in the clean room. Consequently, the electrically charged foreign matters are disadvantageously attached to a tip of the discharge electrode by a principle similar to the principle described above. If the foreign matters are attached to the discharge electrode, a static elimination rate significantly decreases. Moreover, the attached dust and the like gather in a cluster and fall on the clean room. Consequently, there is a possibility that such dust and the like make it difficult to keep the environment of the clean room in a favorable state.

In order to solve the problems, for example, JP 09-017593 A discloses an air ionizing device having a configuration that a tip of a discharge electrode is located inward by a predetermined distance (within 1 mm) with respect to a tip of a nozzle. A rate of sheath gas is set at a rate (not less than 1.0 m/s) which prevents occurrence of inclusion of an air flow at a position near the tip of the nozzle.

In a case where the sheath gas contains no negative gaseous molecules, generated electrons are ejected outside the nozzle in addition to the sheath gas. In a case where the sheath gas contains negative gaseous molecules, generated ions are ejected outside the nozzle. When the discharge electrode is applied with high voltage, an ionic wind is generated at the tip of the discharge electrode, so that a jet stream is generated from the nozzle. However, when the rate of the sheath gas is not less than 1.0 m/s, it is possible to attain a satisfactory seal effect by the sheath gas without such a disadvantage that an induction stream generated by the jet stream causes the inclusion of the air flow at the position near the tip of the nozzle.

On the other hand, JP 2006-040860 A discloses an ionizing device for generating ionized air including ambient air from clean gas emitted from a clean gas emission port which is concentric with a tip of a discharge electrode. A periphery of the discharge electrode is in a substantially open state, that is, no nozzle is present around the discharge electrode. Therefore, even when the nozzle is electrically charged in a single polarity, an electric field at the periphery of the discharge electrode is not weakened, leading to prevention of reduction in amount of ions to be generated. Moreover, the clean gas flows along the tip of the discharge electrode to prevent the foreign matters from being attached to the tip.

When the tip of the discharge electrode protrudes from the clean gas emission port in the clean gas emitting direction, an amount of ionized air to be generated can increase as compared with a case where the tip of the discharge electrode is located inside the clean gas emission port. JP 2006-040860 A describes that a level of the tip of the discharge electrode protruding from the clean gas emission port is fixed based on a balance between the viewpoint of prevention of contamination of the discharge electrode and the viewpoint of the amount of ionized air to be generated.

According to the air ionizing device disclosed in JP 09-017593 A, the sheath gas flows slowly at the rate of about 1.0 m/s, leading to reduction in amount of foreign matters attached to the discharge electrode. However, a satisfactory static elimination effect can not be attained because a static elimination rate decreases. According to the ionizing device disclosed in JP 2006-040860 A, on the other hand, ions are supplied to a target of static elimination with ambient air being included at a position near the discharge electrode. Consequently, there is a possibility that dust and the like collide with and are attached to the tip of the discharge electrode when the ions include the ambient air. As described in JP 2006-040860 A, moreover, since the protrusion level of the tip of the discharge electrode is fixed based on the balance between the viewpoint of prevention of contamination of the discharge electrode and the viewpoint of the amount of ionized air to be generated, the ionizing device fails to enhance both an effect of preventing contamination of the discharge electrode and a satisfactory static elimination effect at a high static elimination rate by the satisfactory amount of ionized air to be generated.

The ionizer is indispensable to attain a satisfactory static elimination effect at a high static elimination rate by a satisfactory amount of ionized air to be generated, and must prevent foreign matters from being attached to the tip of the discharge electrode. The reason therefor is described below. That is, if foreign matters are attached to the tip of the discharge electrode, the amount of ions to be generated decreases, resulting in reduction in amount of ionized air to be generated. Consequently, the satisfactory static elimination effect is not attained because the static elimination rate decreases.

SUMMARY OF THE INVENTION

The present invention has been devised in view of the circumstances described above, and an object thereof is to provide an ionizer and a static elimination method capable of preventing foreign matters from being attached to a tip of a discharge electrode and attaining a satisfactory static elimination effect at a high static elimination rate.

In order to accomplish the object described above, according to a first aspect of the present invention, there is provided an ionizer including a nozzle having a discharge electrode for inducing corona discharge by application of high voltage to eject ions, an emission port for emitting supplied gas together with the ejected ions, and a gas channel for guiding supplied gas to the emission port. Herein, a velocity of flow of the gas immediately after emission from the emission port exceeds a velocity of sound, and a gas pressure at the emission port is not less than an atmospheric pressure.

According to a second aspect of the present invention, in the ionizer according to the first aspect, the discharge electrode is provided at a center of the nozzle, and the gas channel is formed to surround the discharge electrode.

According to a third aspect of the present invention, the ionizer according to the first or second aspect further includes a gas supply port for supplying gas to the gas channel. Herein, the gas is narrowed down at the gas supply port.

According to a fourth aspect of the present invention, in the ionizer according to the third aspect, a ratio of the atmospheric pressure to a gas pressure at a position located forward of the gas supply port is not more than 0.528.

According to a fifth aspect of the present invention, in the ionizer according to the first or second aspect, the gas channel has a throat part for narrowing the gas channel such that a channel area gradually decreases.

According to a sixth aspect of the present invention, in the ionizer according to the fifth aspect, the channel area is minimized at the emission port.

According to a seventh aspect of the present invention, in the ionizer according to the fifth or sixth aspect, a ratio of the atmospheric pressure to a gas pressure at a position where the channel area does not vary, the position being located forward of the throat part, is not more than 0.528.

According to an eighth aspect of the present invention, in the ionizer according to the fifth or seventh aspect, the discharge electrode has a tip formed in a conical shape and induces the corona discharge at the tip, the throat part has a throat surface where the channel area is minimized, and a ratio between the channel area at the throat surface and the channel area at the emission port is adjusted in such a manner that a position of the discharge electrode is changed.

According to a ninth aspect of the present invention, the ionizer according to any one of the first to eighth aspects includes the plurality of nozzles.

In order to accomplish the object described above, moreover, according to a tenth aspect of the present invention, there is provided a static elimination method for, by use of a bar-type ionizer including a plurality of nozzles each having a discharge electrode, the nozzles being provided on one longitudinal surface of a housing in a longitudinal direction of the housing at predetermined intervals, emitting ionized gas obtained by ionizing gas supplied to the nozzle from the emission port toward a target of static elimination. The static elimination method includes: applying positive or negative high voltage to the discharge electrode to generate ions at a periphery of a tip of the discharge electrode; and supplying the gas such that a velocity of flow of the gas immediately after emission from the emission port exceeds a velocity of sound and a gas pressure at the emission port is not less than an atmospheric pressure.

In the first and tenth aspects of the present invention, by use of the bar-type ionizer including the plurality of nozzles each having the discharge electrode, the nozzles being provided on one longitudinal surface of the housing in the longitudinal direction of the housing at the predetermined intervals, the ionized gas obtained by ionizing the gas supplied to the nozzle is emitted from the emission port toward the target of static elimination. The discharge electrode is applied with the positive or negative high voltage to generate the ions at the periphery of the tip thereof. The emission port emits the ionized gas obtained by ionizing the gas using the generated ions toward the target. Herein, the gas is supplied such that the velocity of flow of the gas immediately after emission from the emission port exceeds the velocity of sound and the gas pressure at the emission port is not less than the atmospheric pressure. Thus, the gas can be emitted from the emission port in a so-called optimum expansion status or under expansion status. As a result, it is possible to prevent foreign matters from being attached to the tip of the discharge electrode for ejecting ions, to rapidly bring a satisfactory amount of ionized gas into contact with the target, and to attain a satisfactory static elimination effect at a high static elimination rate.

Herein, the optimum expansion status refers to such an expansion status that when the velocity of flow of the gas immediately after emission from the emission port exceeds the velocity of sound and the gas pressure at the emission port is equal to the atmospheric pressure, an area of an emission region of the gas emitted from the emission port becomes equal to an opening area of the emission port. Moreover, the under expansion status refers to such an expansion status that when the velocity of flow of the gas immediately after emission from the emission port exceeds the velocity of sound and the gas pressure at the emission port is higher than the atmospheric pressure, the area of the emission region of the gas emitted from the emission port becomes larger than the opening area of the emission port. This status is called the under expansion status for the following reason. In the under expansion status, the gas is suppressed from being expanded at a position located forward of the emission port and is expanded after emission, so that an amount of expansion of the gas is small at the position located forward of the emission port.

In the second aspect of the present invention, the discharge electrode is provided at the center of the nozzle, and the gas channel is formed to surround the discharge electrode. Therefore, the discharge electrode for ejecting ions is not eccentric, so that a distance between the discharge electrode and external foreign matters can be maintained at a certain level. Thus, it is possible to further reduce a possibility that the foreign matters are attached to the discharge electrode.

In the third aspect of the present invention, the ionizer includes the gas supply port for supplying the gas to the gas channel, and the gas is narrowed down at the gas supply port. Therefore, the ratio of the atmospheric pressure to the gas pressure at the position located forward of the gas supply port becomes not more than 0.528 without the throat part in the gas channel. As a result, the velocity of flow of the gas immediately after emission from the emission port exceeds the velocity of sound, and the gas pressure at the emission port becomes not less than the atmospheric pressure. Thus, it is possible to set the optimum expansion status or the under expansion status.

In the fourth aspect of the present invention, the ratio of the atmospheric pressure to the gas pressure at the position located forward of the gas supply port is not more than 0.528. As a result, the velocity of flow of the gas immediately after emission from the emission port exceeds the velocity of sound, and the gas pressure at the emission port becomes not less than the atmospheric pressure. Thus, it is possible to set the optimum expansion status or the under expansion status.

In the fifth aspect of the present invention, the gas channel has the throat part for narrowing the gas channel such that the channel area gradually decreases. Therefore, the ratio of the atmospheric pressure to the gas pressure at the position where the channel area does not vary, the position being located forward of the throat part, becomes not more than 0.528. Moreover, the velocity of flow of the gas immediately after emission from the emission port exceeds the velocity of sound, and the gas pressure at the emission port is not less than the atmospheric pressure. Thus, it is possible to set the optimum expansion status or the under expansion status. In particular, the surface where the channel area is minimized (the throat surface) is defined near the emission port. Herein, the distance from the throat surface to the emission port is made approximate to 0 (zero) and the ratio of the channel area at the discharge port to the channel area at the throat surface is made approximate to 1. Thus, it is possible to set the optimum expansion status or the under expansion status even when the amount of flow of the gas is small.

In the sixth aspect of the present invention, the channel area is minimized at the emission port. Therefore, the emission port can be used as the throat part without the throat part provided on the midpoint position of the gas channel. Moreover, the ratio of the atmospheric pressure to the gas pressure at the position where the channel area does not vary, the position being located forward of the throat part, is not more than 0.528. As a result, the velocity of flow of the gas immediately after emission from the emission port exceeds the velocity of sound, and the gas pressure at the emission port becomes not less than the atmospheric pressure. Thus, it is possible to set the optimum expansion status or the under expansion status.

In the seventh aspect of the present invention, the ratio of the atmospheric pressure to the gas pressure at the position where the channel area does not vary, the position being located forward of the throat part, is not more than 0.528. As a result, the velocity of flow of the gas immediately after emission from the emission port exceeds the velocity of sound, and the gas pressure at the emission port becomes not less than the atmospheric pressure. Thus, it is possible to set the optimum expansion status or the under expansion status.

In the eighth aspect of the present invention, the discharge electrode has the conical tip and induces corona discharge at the conical tip, the throat part has the throat surface where the channel area is minimized, and the ratio between the channel area at the throat surface and the channel area at the emission port is adjusted while the position of the discharge electrode is changed. The throat part is provided near the emission port at the conical tip of the discharge electrode, and the ratio between the channel area at the throat surface and the channel area at the emission port is made approximate to 1. As a result, the velocity of flow of the gas for achieving the optimum expansion can be decreased. Thus, it is possible to suppress the amount of flow of the gas. Moreover, the optimum expansion can be achieved at a low gas pressure when the distance between the throat surface and the emission port is made approximate to 0 (zero). For example, when the gas is supplied at a pressure of about 0.09 MPa, the gas emitted from the emission port can be supplied in the so-called optimum expansion status or under expansion status. Thus, it is possible to enhance the effect of preventing foreign matters from being attached to the tip of the discharge electrode for ejecting ions.

In the ninth aspect of the present invention, the ionizer includes the plurality of nozzles. As a result, it is possible to efficiently eliminate static electricity from a target of static elimination in a wide range at a time. Moreover, negative electrodes and positive electrodes can be selectively used as the discharge electrodes of the plurality of nozzles. Thus, it is possible to employ a variety of voltage application methods.

With the configurations described above, it is possible to prevent foreign matters from being attached to a tip of a discharge electrode for ejecting ions, to rapidly bring a satisfactory amount of ionized gas into contact with a target of static elimination, and to attain a satisfactory static elimination effect at a high static elimination rate.

BRIEF DESCRIPTION OF THE DRAWINGS

FIG. 14 shows a table of a result of evaluation on an amount of foreign matters attached to the discharge electrode in a case where the ionizer according to the first embodiment is in the respective expansion statuses in which the velocity of flow of the gas is not more than and exceeds the velocity of sound;

FIGS. 17A to 17D exemplarily show four nozzles having emission ports which are different in diameter from one another, for use in the ionizer according to the first embodiment;

FIGS. 19A to 19D show tables of pressures, rates, areas and the like of the nozzles shown in FIGS. 17A to 17D in the optimum expansion status and the like;

FIGS. 20A to 20D show a table of a relation between the pressure and the rate in each expansion status based on the pressure and the like shown in FIGS. 19A to 19D, respectively;

DETAILED DESCRIPTION OF THE PREFERRED EMBODIMENTS

Figure 1:
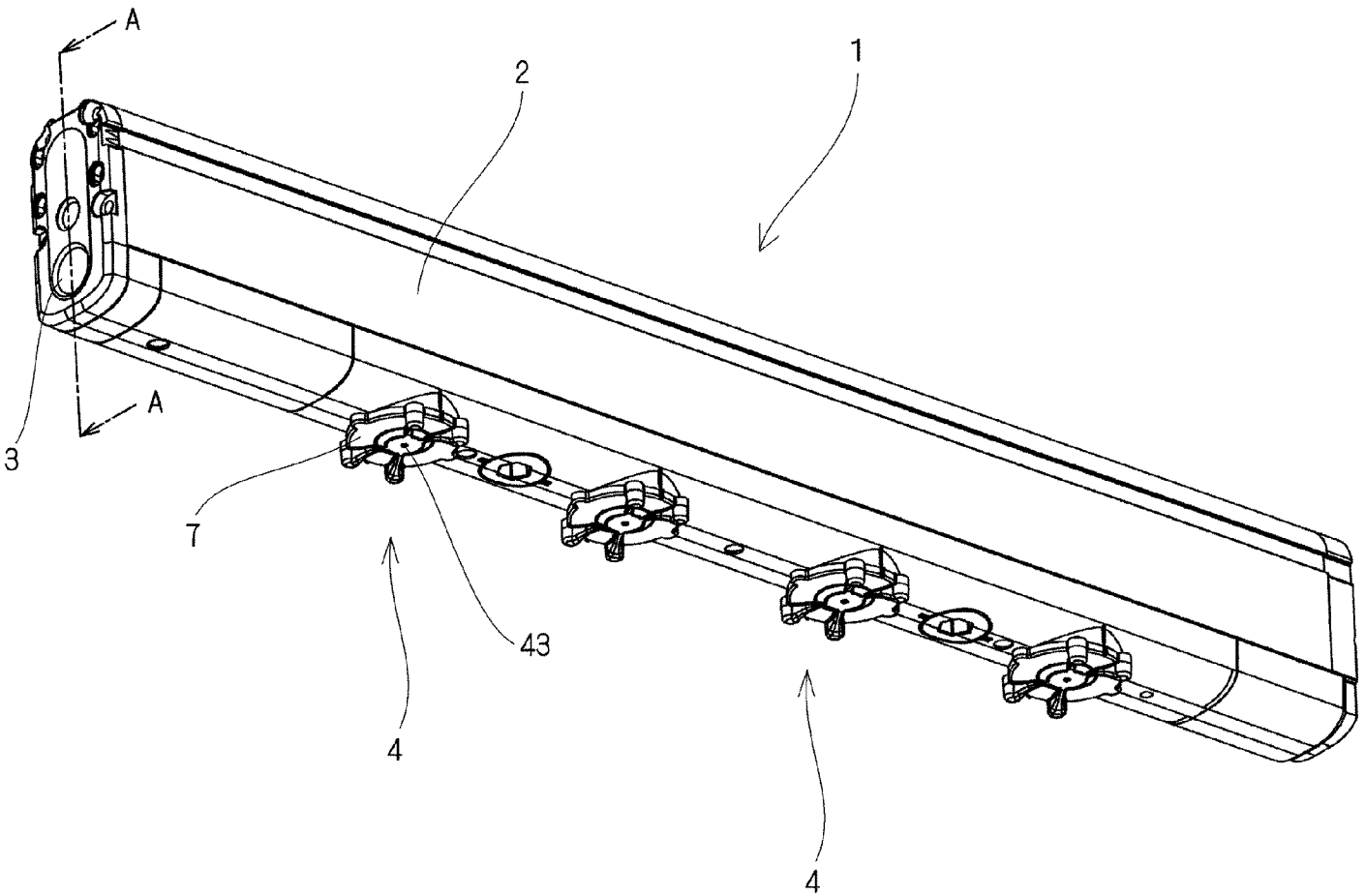
FIG. 1 shows a perspective view of a schematic configuration of an ionizer according to a first embodiment of the present invention.

With reference to the drawings, hereinafter, description will be given of an ionizer according to an embodiment of the present invention. In the drawings for reference, elements having identical or similar configurations or functions are denoted by identical or similar reference symbols, and repetitive description thereof will not be given here.

First Embodiment

FIG. 1 shows a perspective view of a schematic configuration of an ionizer according to a first embodiment of the present invention. As shown in FIG. 1, the ionizer 1 according to the first embodiment is of a so-called bar type and includes a main body casing 2 and a plurality (four in the example shown in FIG. 1) of nozzles 4. The main body casing 2 is in a substantially rectangular parallelepiped shape and has rounded longitudinal corners. The plurality of nozzles 4 are provided on one surface of the main body casing 2 in a longitudinal direction of the main body casing 2 at predetermined intervals. Each nozzle 4 is embedded in the main body casing 2 except a disc-shaped portion 7 having an emission port 43 for emitting supplied gas together with ions ejected from a discharge electrode (to be described later). A gas supplying port 3 is provided on a longitudinal end surface of the main body casing 2 and supplies, to each nozzle 4, clean gas obtained by filtrating air, nitrogen gas and the like. An air unit 21 (see FIG. 6) forms a part of the main body casing 2 and closes a lower end opening of the main body casing 2. Moreover, a high-voltage unit, a control unit including an electric circuit, a CPU and the like, and the like (not shown) are provided at predetermined positions of the main body casing 2.

Figure 2A:
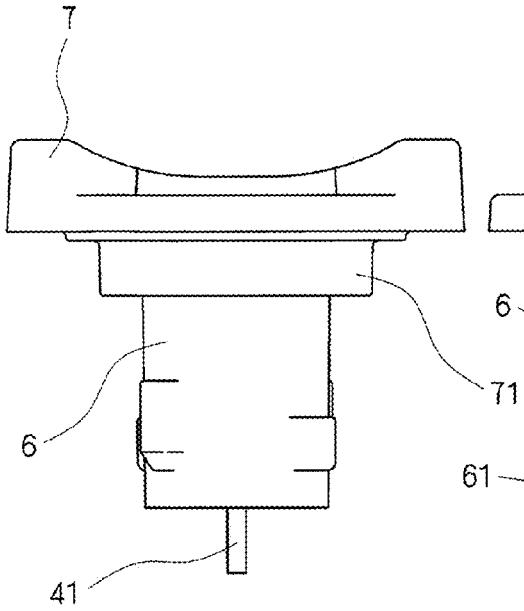
FIG. 2A shows a front view of a nozzle according to the first embodiment as seen in a vertical direction of an axis of a discharge electrode.
Figure 2C:
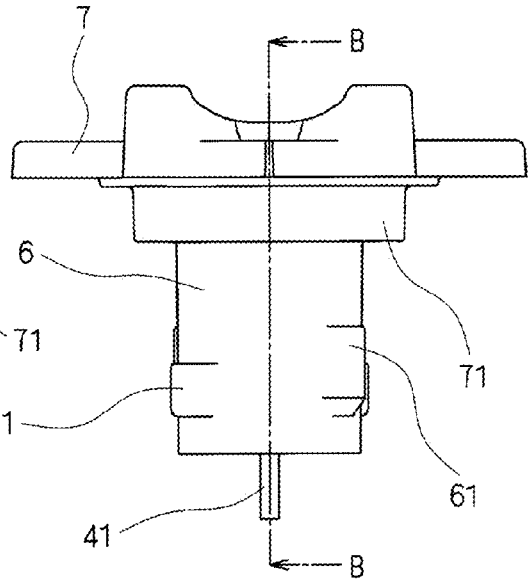
FIG. 2C shows a side view of the same nozzle as seen from the opposite side to the emission port.
Figure 2B:
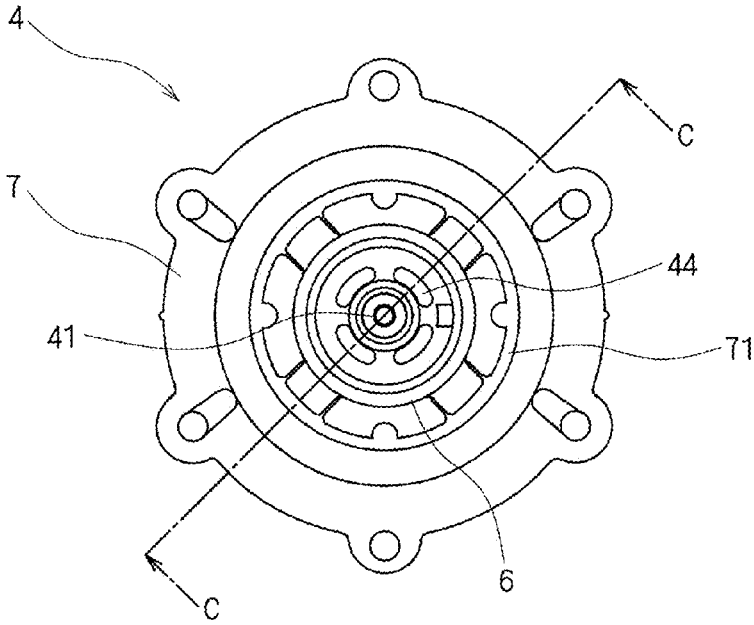
FIG. 2B shows a bottom view of the same nozzle as seen from an opposite side to an emission port.

FIG. 2A shows a front view of the nozzle 4 according to the first embodiment as seen in a vertical direction of an axis of the discharge electrode, FIG. 2B shows a bottom view of the nozzle 4 as seen from an opposite side to the emission port, and FIG. 2C shows a side view of the nozzle 4 as seen from the opposite side to the emission port. As shown in FIGS. 2A to 2C, the nozzle 4 includes a tube-shaped portion 6 in addition to the disc-shaped portion 7. The disc-shaped portion 7 has an outer diameter which is almost twice as large as an outer diameter of the tube-shaped portion 6. A tube-shaped projection 71 is formed on the disc-shaped portion 7 at a position beside the tube-shaped portion 6 and serves as a portion by which the nozzle 4 is fastened to the main body casing 2. The tube-shaped projection 71 has an outer diameter which is substantially intermediate between the outer diameter of the disc-shaped portion 7 and the outer diameter of the tube-shaped portion 6. The nozzle 4 also includes the discharge electrode 41 for inducing corona discharge by application of high voltage to eject ions. In the example shown in FIGS. 2A to 2C, the discharge electrode 41 is a needle electrode. Herein, the discharge electrode 41, the tube-shaped portion 6 and the disc-shaped portion 7 are arranged concentrically.

Figure 3B:
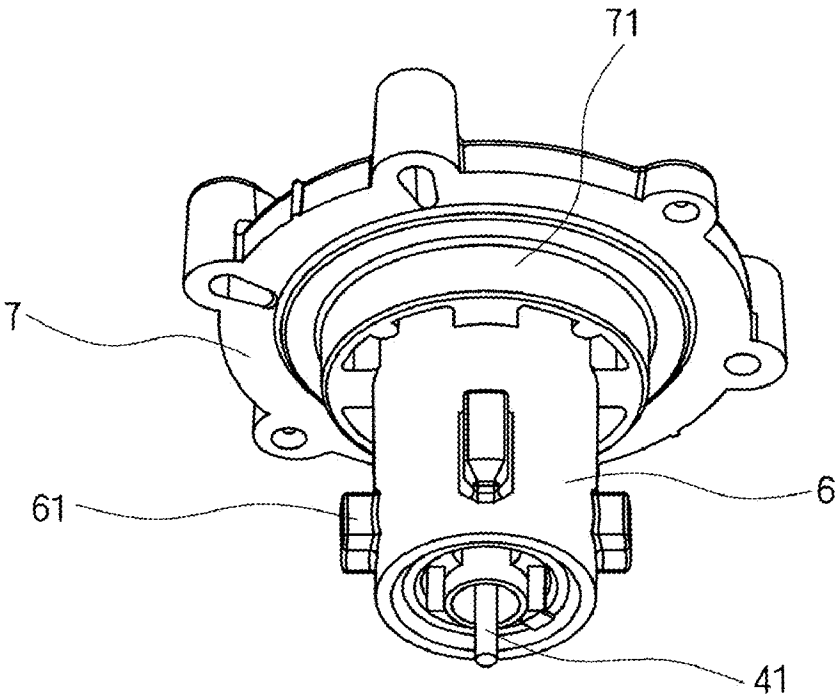
FIGS. 3A and 3B show perspective views of the nozzle according to the first embodiment.
Figure 3A:
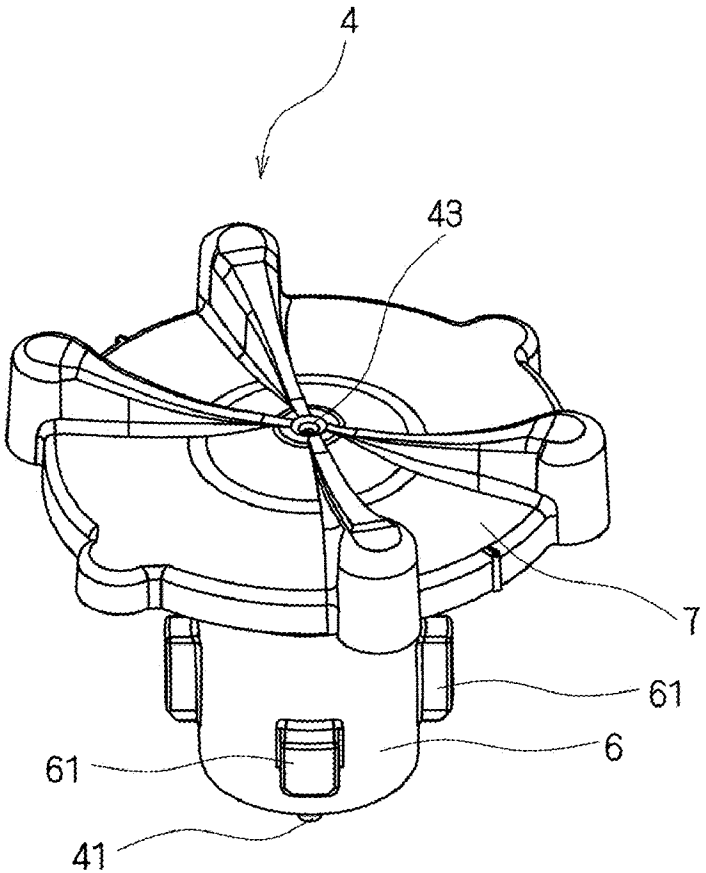
Figure 4:
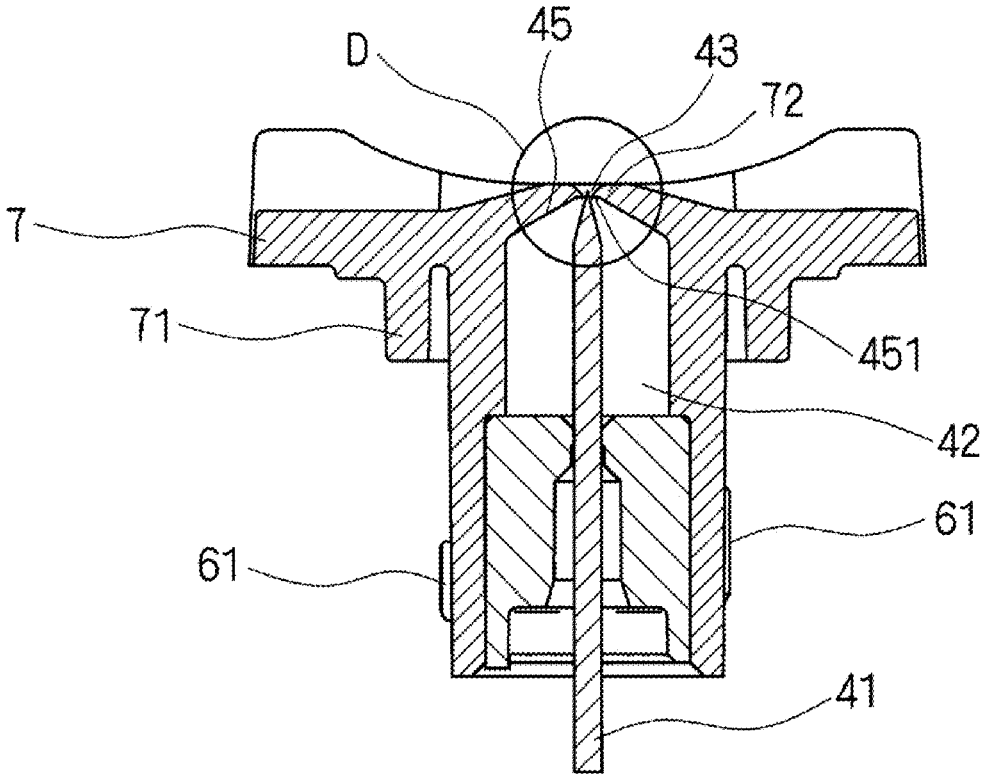
FIG. 4 shows a sectional view taken along a line B-B in the side view shown in FIG. 2C.

FIG. 3A shows a perspective view of the nozzle 4 according to the first embodiment as seen from a diagonally upper side of the nozzle 4, and FIG. 3B shows a perspective view of the nozzle 4 as seen from a diagonally lower side of the nozzle 4. As shown in FIGS. 3A and 3B, a plurality of projections 61 are formed on the tube-shaped portion 6 of the nozzle 4 and serve as portions by which the nozzle 4 is fit and fixed to the main body casing 2. FIG. 4 shows a sectional view taken along a line B-B in the side view shown in FIG. 2C.

As shown in FIGS. 3B and 4, the tube-shaped projection 71 protrudes downward from the disc-shaped portion 7 and has a closed upper surface. The nozzle 4 is embedded in the main body casing 2 in a state that a bottom surface of the tube-shaped projection 71 comes into contact with the main body casing 2. Herein, the disc-shaped portion 7 is spaced apart from the main body casing 2 except the tube-shaped projection 71. In addition to the discharge electrode 41 and the emission port 43, as shown in FIG. 4, the nozzle 4 also includes a gas channel 42 for guiding supplied gas to the emission port 43.

Figure 5:
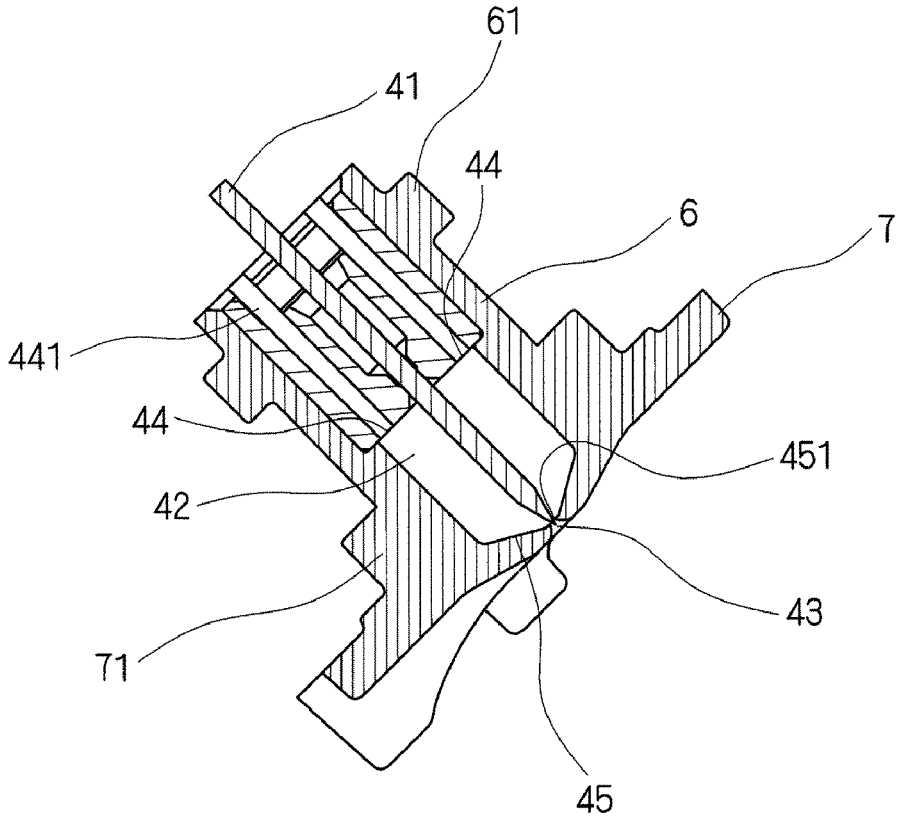
FIG. 5 shows a sectional view taken along a line C-C in the bottom view shown in FIG. 2B.
Figure 6:
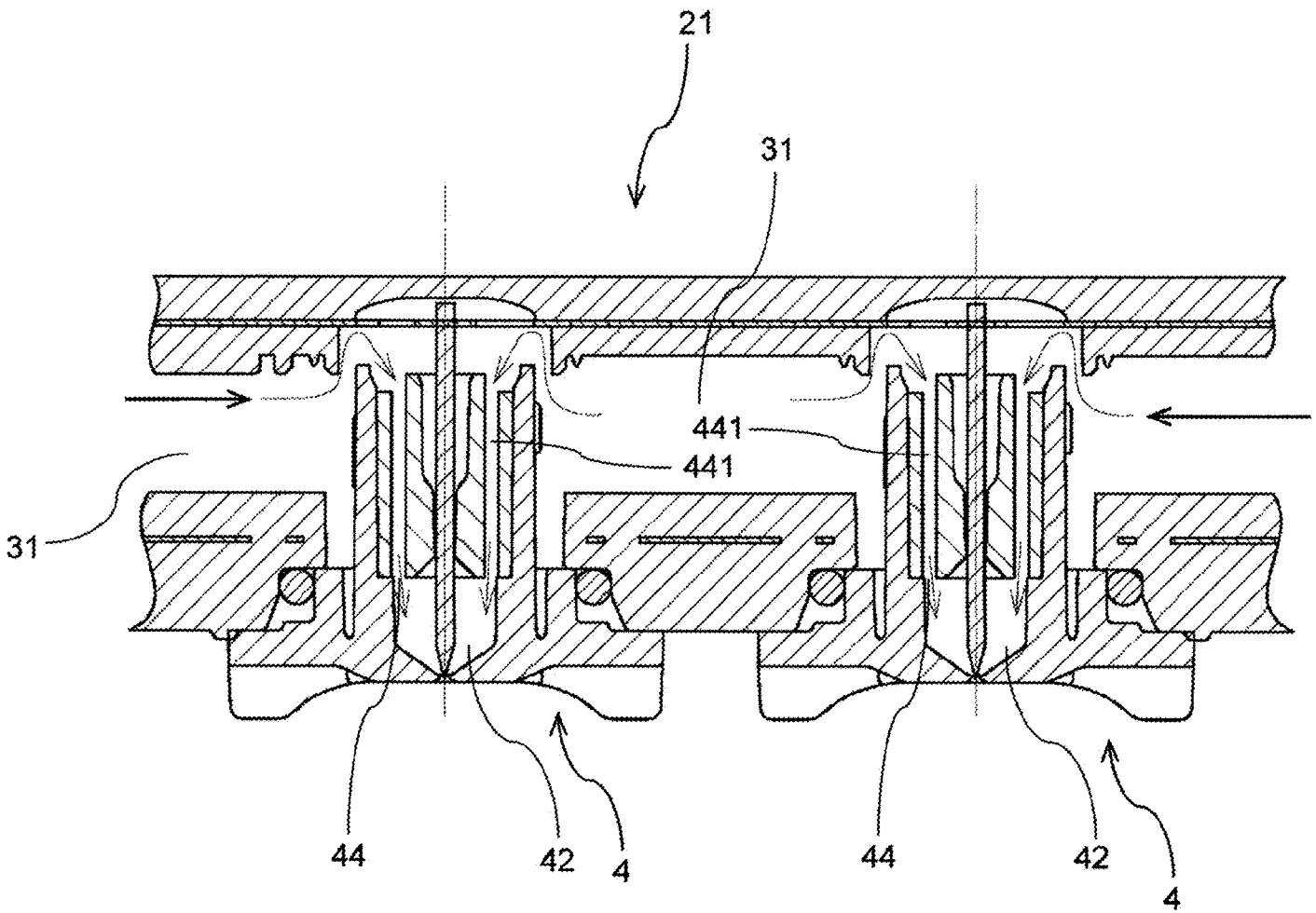
FIG. 6 shows a partial sectional view taken along a line A-A in the perspective view shown in FIG. 1.
Figure 7:
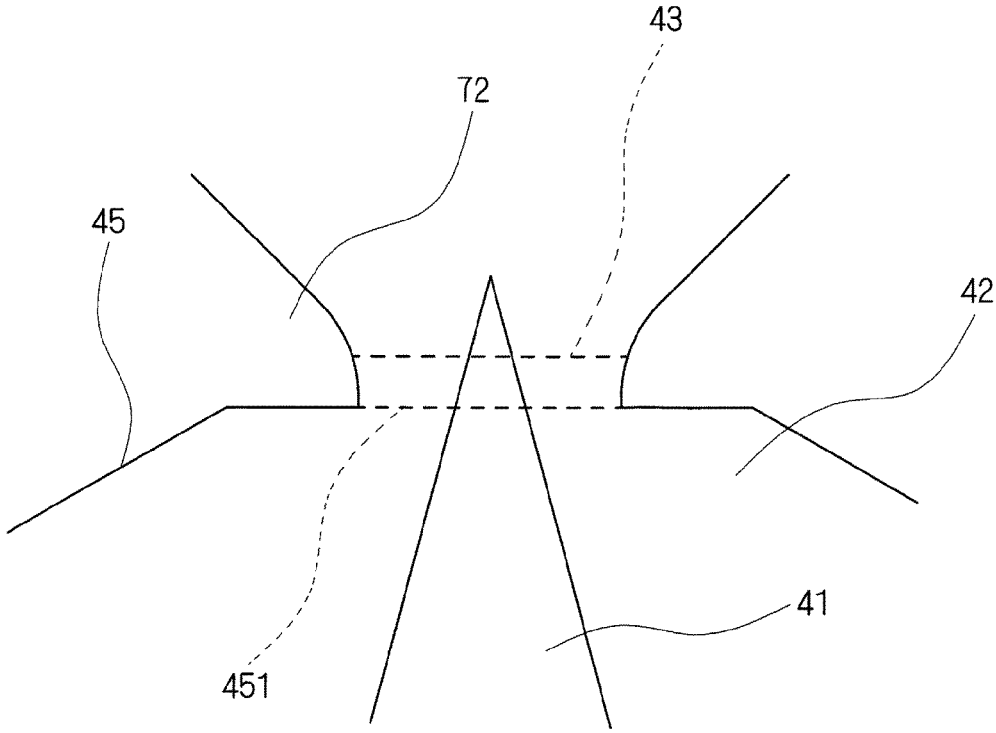
FIG. 7 shows an enlarged view of a portion D shown in FIG. 4.

FIG. 5 shows a sectional view taken along a line C-C in the bottom view shown in FIG. 2B. As shown in FIG. 5, the nozzle 4 also includes a gas supply port 44 for supplying gas to the gas channel 42. FIG. 6 shows a partial sectional view taken along a line A-A in the perspective view shown in FIG. 1. As shown by arrow marks in FIG. 6, gas supplied to the gas supplying port 3 of the main body casing 2 shown in FIG. 1 is supplied from a main gas supply passage 31 formed inside the main body casing 2 in the longitudinal direction of the main body casing 2 to the gas supply port 44 via a gas channel 441 formed inside the nozzle 4. FIG. 7 shows an enlarged view of a portion D shown in FIG. 4.

As shown in FIGS. 4 and 7, the discharge electrode 41 is provided at a substantially center of the nozzle 4, and the gas channel 42 is formed to surround the discharge electrode 41. Since the discharge electrode 41 for ejecting ions is not eccentric, even if external foreign matters are found, a distance between the foreign matters and the discharge electrode 41 is maintained at a certain level. As a result, a possibility that the foreign matters are attached to the discharge electrode 41 can be reduced as much as possible. Herein, examples of a method for applying voltage to the discharge electrode 41 include various methods such as a pulse AC method, a DC method, an AC method, a high-frequency AC method and a pulse DC method.

The pulse AC method involves alternately applying positive direct-current voltage and negative direct-current voltage to one discharge electrode to alternately generate positive ions and negative ions. The DC method involves applying only positive direct-current voltage or negative direct-current voltage to one discharge electrode to generate only positive ions or negative ions. The AC method involves applying alternating-current voltage to one discharge electrode to alternately generate positive ions and negative ions. The high-frequency AC method is similar to the AC method, but is different from the AC method in a point that a voltage switch cycle is about 1000 times as rapid as that in the AC method. The pulse DC method involves alternately applying direct-current voltage to a positive discharge electrode and a negative discharge electrode to alternately generate positive ions from the positive discharge electrode and negative ions from the negative discharge electrode. An amount of ions to be generated increases when the direct-current voltage rather than the alternating-current voltage is applied; therefore, the direct-current voltage makes ion balance good in a case where one discharge electrode alternately generates positive ions and negative ions. Although the voltage application method is not particularly limited in the present invention, it is preferable that voltage is applied by the pulse AC method which realizes a high static elimination rate and is excellent in ion balance.

Figure 8:
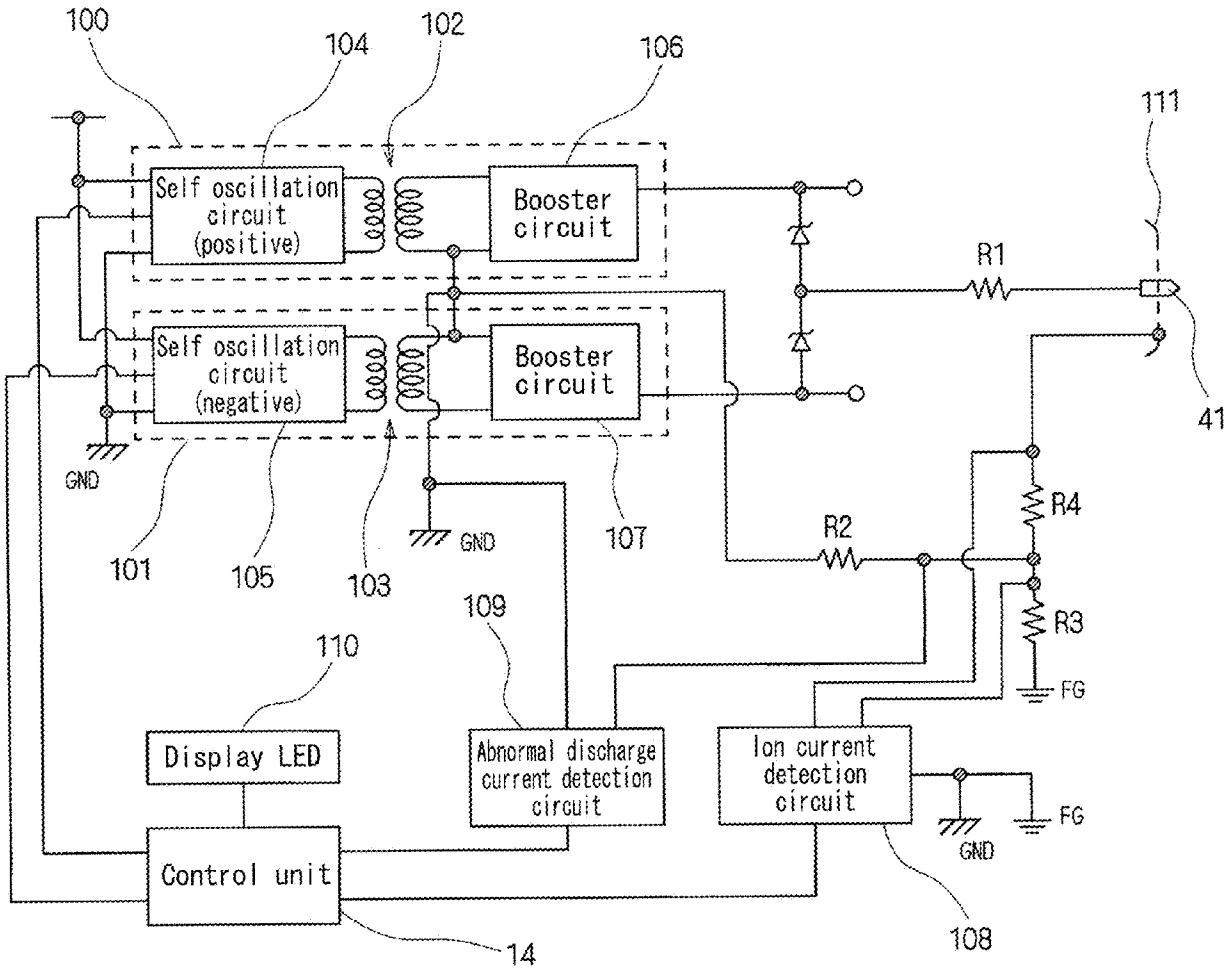
FIG. 8 shows a circuit diagram of a general outline of an electric circuit of the ionizer for applying voltage by a pulse AC method.

FIG. 8 shows a circuit diagram of a general outline of an electric circuit of the ionizer 1 for applying voltage by the pulse AC method. As shown in FIG. 8, the ionizer 1 includes a positive-side high-voltage generation circuit 100 and a negative-side high-voltage generation circuit 101 each forming the high-voltage unit (not shown). Herein, the high-voltage unit is housed in an enclosed box (not shown). The positive-side high-voltage generation circuit 100 includes a self oscillation circuit 104 connected to a primary coil of a transformer 102, and a booster circuit 106 connected to a secondary coil of the transformer 102. The negative-side high-voltage generation circuit 101 includes a self oscillation circuit 105 connected to a primary coil of a transformer 103, and a booster circuit 107 connected to a secondary coil of the transformer 103. Each of the booster circuits 106 and 107 is a voltage multiplying rectifier, for example.

A protective resistor (first resistor R1) is formed between the discharge electrode 41 and the high-voltage generation circuits 100 and 101. A second resistor R2 and a third resistor R3 are connected in series between a frame ground FG and a ground end GND of the secondary coils of the transformers 102 and 103. A fourth resistor R4 and the third resistor R3 are connected in series between a common electrode plate 111 and the frame ground FG. Herein, the common electrode plate 111 is embedded in the main body casing 2 at a position near the bottom surface.

An ion current detection circuit 108 detects electric current flowing through the fourth resistor R4 to measure ion balance at a position near the discharge electrode 41. Moreover, an ion current detection circuit 108 detects electric current flowing through the third resistor R3 to measure ion balance at a position near a target of static elimination. Examples of the target include not only electrically charged objects, but also electrically charged air, and the like. An abnormal discharge current detection circuit 109 detects electric current flowing through the second resistor R2 to detect abnormal electrical discharge occurring between the discharge electrode 41 and the common electrode plate 111 or the frame ground FG. Upon determination that the abnormal electrical discharge occurs, the control unit 14 activates a display LED 110 such that the display LED 110 emits light, and this light makes an operator aware of the abnormal electrical discharge.

According to the voltage application method shown in FIG. 8, that is, the pulse AC method, when the positive-side high-voltage generation circuit 100 and the negative-side high-voltage generation circuit 101 alternately generate high voltages, one discharge electrode 41 alternately generates positive ions and negative ions. More specifically, when the positive-side high-voltage generation circuit 100 generates positive high voltage, corona discharge occurs. Herein, electrons are extracted from molecules of air at a position around the tip of the discharge electrode 41. Thus, the discharge electrode 41 generates positive ions. On the other hand, when the negative-side high-voltage generation circuit 101 generates negative high voltage, corona discharge occurs. Then, the discharge electrode 41 emits electrons from the tip thereof, and the emitted electrons collide with molecules of air. Thus, the discharge electrode 41 generates negative ions.

The target is alternately brought into contact with the positive ions and the negative ions generated by the discharge electrode 41. It is assumed herein that the target has a positive polarity. When the positive ions come into contact with the target, the target repels the positive ions. On the other hand, when the negative ions come into contact with the target, the target is bound to the negative ions and is electrically neutralized. Moreover, it is assumed herein that the target has a negative polarity. When the positive ions come into contact with the target, the target is bound to the positive ions and is electrically neutralized. On the other hand, when the negative ions come into contact with the target, the target repels the negative ions. Accordingly, the pulse AC method which is the voltage application method allows elimination of static electricity from a target of static elimination by neutralization of the target with good ion balance even when the target has either a positive polarity or a negative polarity.

In the ionizer 1 according to the first embodiment, the discharge electrode 41 induces corona discharge by application of high voltage to ionize ambient gas, and the emission port 43 emits the ionized gas. The ionized gas emitted from the emission port 43 comes into contact with a target of static elimination (not shown) to eliminate static electricity from the target. Herein, the gas is selected from air, nitrogen gas and the like which have been used conventionally and typically. In a case where the gas to be used is air, the air is filtrated using a filter and the like to obtain clean dry air, and this clean dry air is used in actual. Moreover, the gas to be emitted from the emission port 43 is ionized gas; however, the "ionized gas" is simply described as the "gas" in some instances for facilitation of the description.

Figure 9A:
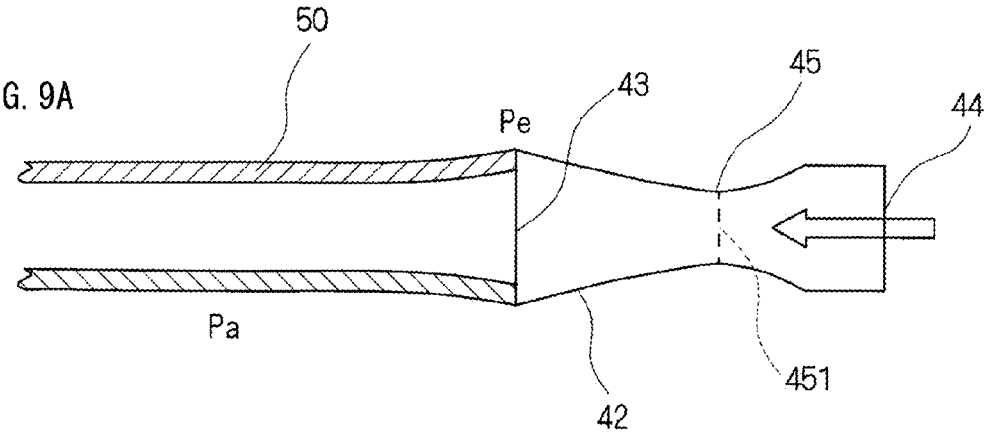
FIGS. 9A to 9C schematically show three expansion statuses of gas emitted from the emission port of the nozzle at a velocity of flow exceeding a velocity of sound.
Figure 9B:
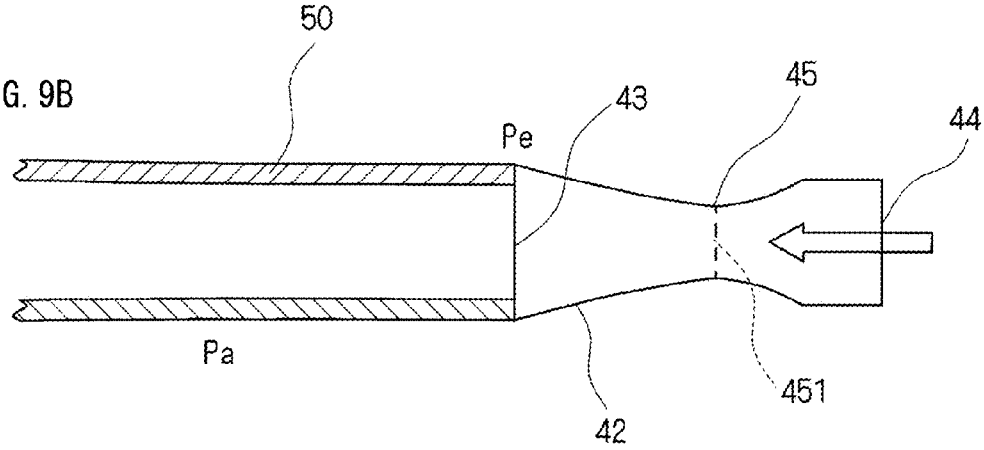
Figure 9C:
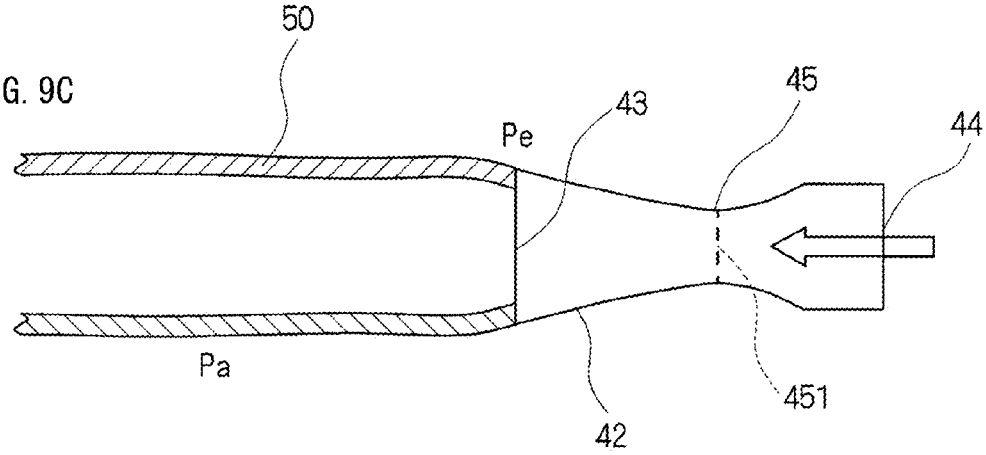

In the ionizer 1 according to the first embodiment, the emission port 43 emits ionized gas at a velocity of flow exceeding a velocity of sound such that a pressure at the emission port 43 is not less than an atmospheric pressure. As shown in FIGS. 4 to 7, the gas channel 42 has a throat part 45 for narrowing the gas channel 42 such that a channel area gradually decreases. Herein, the velocity of sound varies depending on temperature, and is about 340 m/s in a sea level at 15° C. The velocity of flow of the gas can be represented by a Mach number of a ratio of the velocity of flow to the velocity of sound. In a case where the velocity of sound is 340 m/s, the velocity of flow of 272 m/s can be represented as a Mach number of 0.8 (M0.8) because it is 80% of the velocity of sound. Moreover, the velocity of flow of 340 m/s can be represented as M1. Accordingly, the velocity of flow exceeding the velocity of sound (about 340 m/s) can be represented by a numeric value exceeding M1. FIGS. 9A to 9C schematically show three expansion statuses of the gas emitted from the emission port 43 of the nozzle 4 at the velocity of flow exceeding the velocity of sound. Specifically, FIG. 9A shows an over expansion status, FIG. 9B shows an optimum expansion status, and FIG. 9C shows an under expansion status.

Prior to the description about the respective expansion statuses, description will be given of a condition required in order that the velocity of flow of the gas emitted from the emission port 43 exceeds the velocity of sound. The gas channel 42 shown in FIGS. 9A to 9C has a shape called a rubber nozzle shape. In FIGS. 9A to 9C, the gas flows through the gas channel 42 in a direction of an arrow mark. The gas channel 42 has a throat surface 451 defined at a midpoint position between the gas supply port 44 and the emission port 43. The channel area is minimized at the throat surface 451 of the throat part 45 for narrowing the gas channel 42 such that the channel area gradually decreases. Herein, the channel area of the gas channel 42 does not include a sectional area of the discharge electrode 41. When the velocity of flow of the gas immediately after passing through the throat surface 451 exceeds the velocity of sound represented by M1, the velocity of flow of the gas emitted from the emission port 43 exceeds the velocity of sound. That is, a velocity of flow of supplied gas immediately after passing through the throat surface 451 exceeds a velocity of sound on a condition that a ratio of an atmospheric pressure to a gas pressure at a position where the channel area of the gas channel 42 does not vary, the position being located forward of the throat part 45, is not more than 0.528.

Figure 10A:
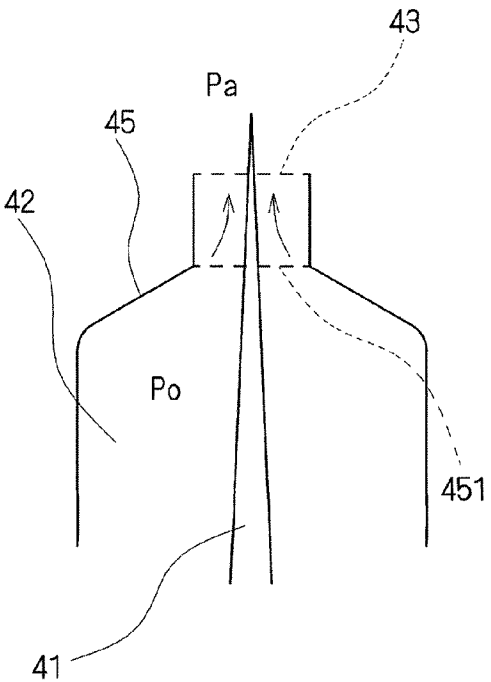
FIGS. 10A to 10C show schematic views for describing a condition required in order that the velocity of flow of the gas emitted from the emission port exceeds the velocity of sound.
Figure 10B:
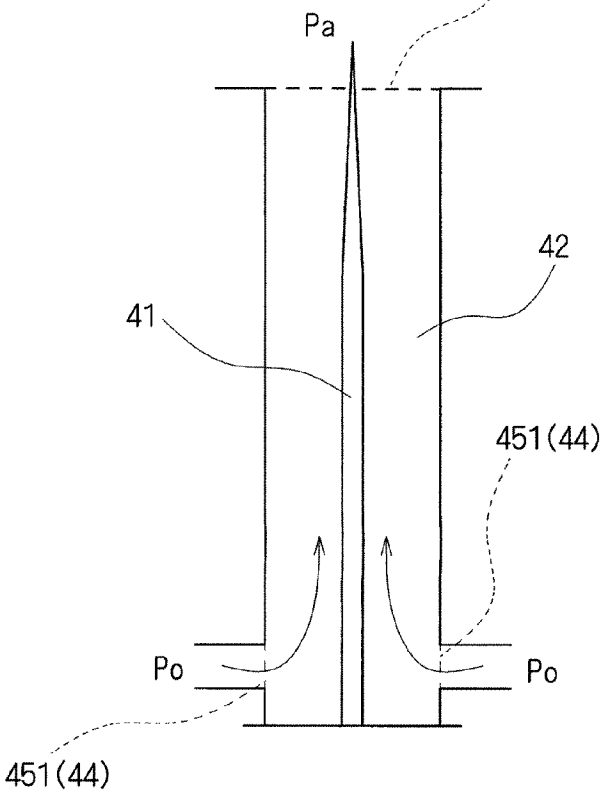
Figure 10C:
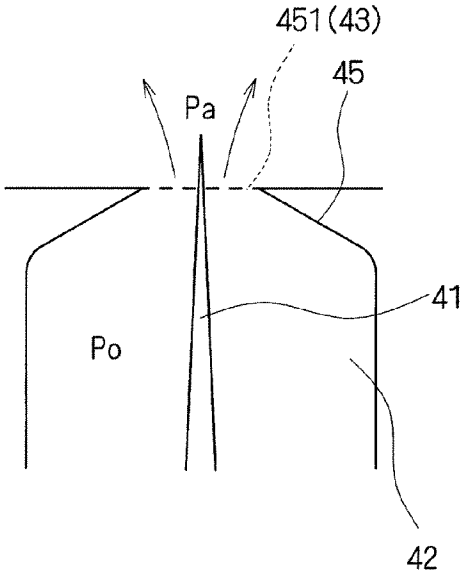

FIGS. 10A to 10C show schematic views for describing the condition required in order that the velocity of flow of the gas emitted from the emission port 43 exceeds the velocity of sound. Herein, FIG. 10A shows a case where the throat surface 451 is at the midpoint position of the gas channel 42, FIG. 10B shows a case where the gas supply port 44 serves as the throat surface 451, and FIG. 10C shows a case where the throat surface 451 is on the emission port 43. The throat surface 451 shown in FIG. 10A is defined at the midpoint position of the gas channel 42, as in the rubber nozzle shape shown in FIGS. 9A to 9C. As shown in FIG. 10A, therefore, the velocity of flow of the gas immediately after passing through the throat surface 451 exceeds the velocity of sound on a condition that a ratio of the atmospheric pressure Pa to a gas pressure Po at a position where the channel area of the gas channel 42 does not vary, the position being located forward of the throat part 45, is not more than 0.528. Herein, it is preferable that the gas channel 42 has a chamber for retaining a certain amount of gas, the chamber being formed forward of the throat surface 451, such that gas is supplied to the throat surface 451 at uniform pressure.

Even when the throat part 45 is not formed as shown in FIG. 10B, the gas supply port 44 serves as the throat surface 451, so that the ratio of the atmospheric pressure Pa to the gas pressure Po at the position located forward of the gas supply port 44 becomes not more than 0.528. In such a case, the velocity of flow of the gas in the gas channel 42 exceeds the velocity of sound; therefore, the velocity of flow of the gas emitted from the emission port 43 also exceeds the velocity of sound. In a case where the bar-type ionizer 1 includes the nozzle 4 in which the gas supply port 44 serves as the throat surface 451 as shown in FIG. 10B, the gas pressure Po corresponds to a gas pressure at the main gas supply passage 31 formed inside the housing (main body casing 2) of the ionizer 1 in the longitudinal direction of the housing.

In the case where the emission port 43 serves as the throat surface 451 as shown in FIG. 10C, the velocity of flow of the gas emitted from the emission port 43 exceeds the velocity of sound when the ratio of the atmospheric pressure Pa to the gas pressure Po at the position where the channel area of the gas channel 42 does not vary, the position being located forward of the emission port 43, becomes not more than 0.528. The ionizer 1 according to the first embodiment includes the nozzle 4 having the throat surface 451 defined as shown in FIG. 10A. Alternatively, the ionizer 1 may include the nozzle 4 having the throat surface 451 defined as shown in FIG. 10B or 10C as long as the velocity of flow of the gas immediately after emission from the emission port 43 exceeds the velocity of sound and the gas pressure at the emission port 43 becomes not less than the atmospheric pressure.

Next, the respective expansion statuses are described. As shown in FIGS. 9A to 9C, the gas supplied from the gas supply port 44 of the gas channel 42 is narrowed down at the throat part 45 and then is emitted from the emission port 43 at the velocity of flow exceeding the velocity of sound. When the gas pressure Pe at the emission port 43 is lower than the atmospheric pressure Pa, an area of an emission region of the emitted gas becomes smaller than an opening area of the emission port 43 because the gas is pushed by ambient air as shown in FIG. 9A, so that the emission region 50 is compressed. This status is referred to as the over expansion status. Moreover, when the gas pressure Pe at the emission port 43 is equal to the atmospheric pressure Pa, the area of the emission region of the emitted gas is equal to the opening area of the emission port 43 as shown in FIG. 9B, so that the emission region 50 is neither compressed nor expanded. This status is referred to as the optimum expansion status. Further, when the gas pressure Pe at the emission port 43 is higher than the atmospheric pressure Pa, the area of the emission region of the emitted gas becomes larger than the opening area of the emission port 43 as shown in FIG. 9C because the gas pushes ambient air, so that the emission region 50 is expanded. This status is referred to as under expansion status.

In each of the expansion statuses shown in FIGS. 9A to 9C, the velocity of flow of the gas emitted from the emission port 43 exceeds the velocity of sound. Therefore, air, dust and the like in the vicinity of the emission gas 43 are blown off at the emission port 43 by the gas emitted at the velocity of flow exceeding the velocity of sound without flowing into the emission port 43 and, as a result, are less prone to flow into the emission port 43. In the over expansion status shown in FIG. 9A, however, the gas emitted from the emission port 43 is pushed by ambient air, so that the emission region 50 is compressed. Consequently, there is a possibility that dust and the like in the vicinity of the emission port 43 flow into the emission port 43. In the optimum expansion status shown in FIG. 9B and the under expansion status shown in FIG. 9C, on the other hand, the emission region 50 of the gas emitted from the emission port 43 is not compressed. Therefore, there is a low possibility that dust and the like in the vicinity of the emission port 43 flow into the emission port 43. As a result, the dust and the like are less prone to be attached to the discharge electrode 41 at the position near the emission port 43. The effect of preventing dust and the like from being attached to the discharge electrode 41 is enhanced in the under expansion status that the emission region 50 is expanded, as compared with the optimum expansion status that the emission region 50 is neither compressed nor expanded. For this reason, it is preferable that even when the velocity of flow of the gas exceeds the velocity of sound, the gas pressure Pe at the emission port 43 is higher than the atmospheric pressure Pa and the gas is emitted in the under expansion status.

Figure 11A:
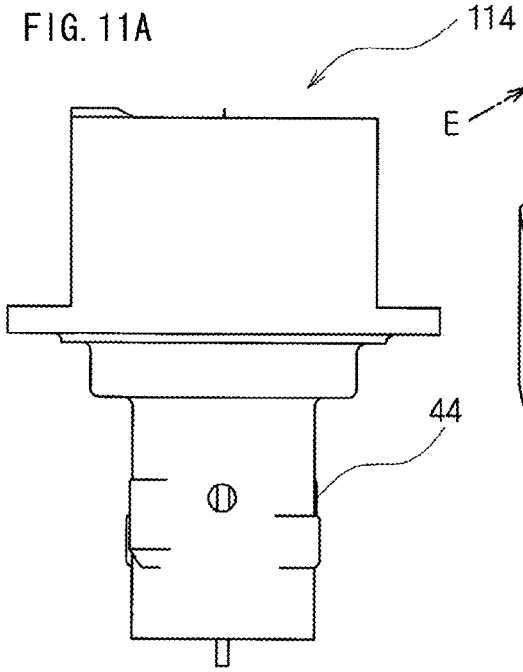
FIGS. 11A to 11D show a pressure evaluating nozzle for determining the expansion status.
Figure 11B:
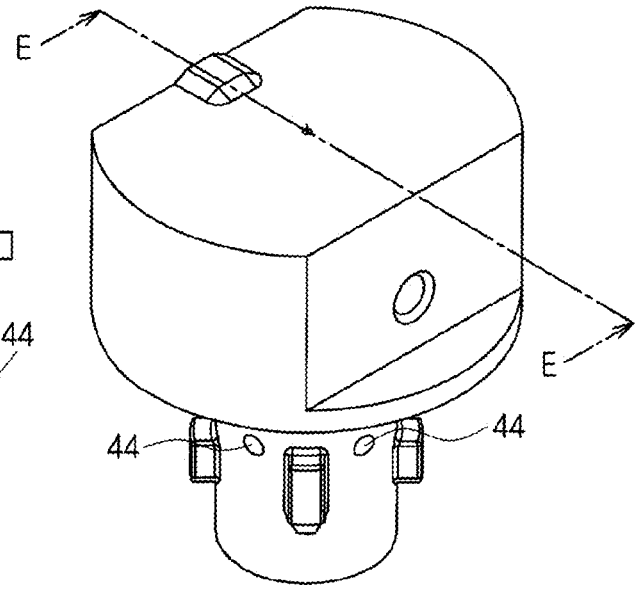
Figure 11C:
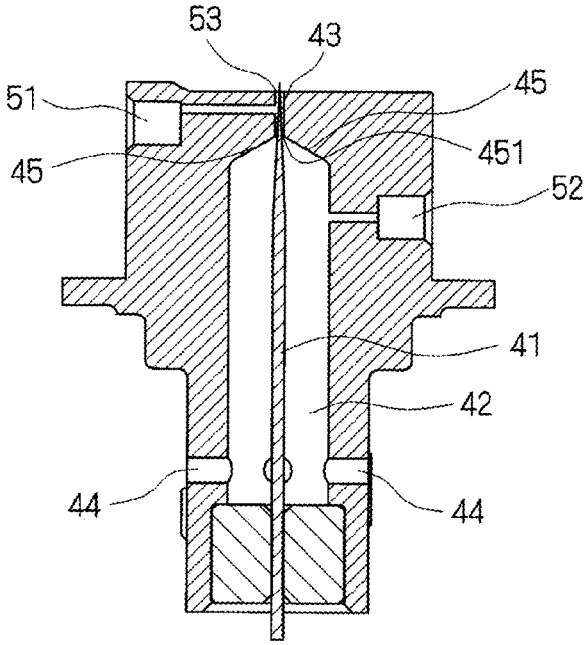
Figure 11D:
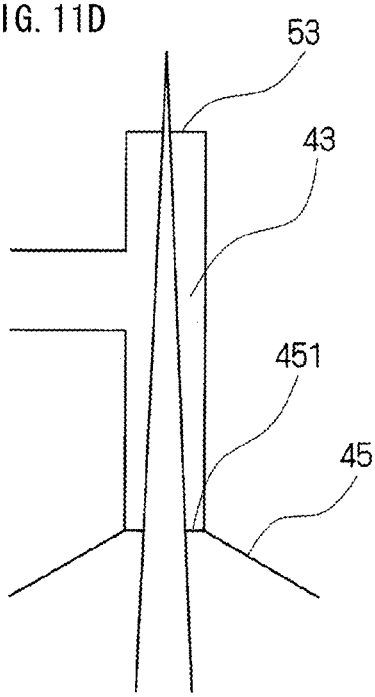

FIG. 11A shows a front view of a pressure evaluating nozzle 114 for determining the expansion status. FIG. 11B shows a perspective view of the pressure evaluating nozzle 114 as seen from a diagonally upper side. FIG. 11C shows a sectional view taken along a line E-E in the perspective view shown in FIG. 11B. FIG. 11D shows an enlarged view of a periphery of an emission port 43 shown in FIG. 11C. As shown in FIGS. 11A to 11D, the pressure evaluating nozzle 114 includes a discharge electrode 41, a gas channel 42, the emission port 43, a gas supply port 44, a throat part 45 and a throat surface 451, as in the nozzle 4 of the ionizer 1 according to the first embodiment.

Figure 12:
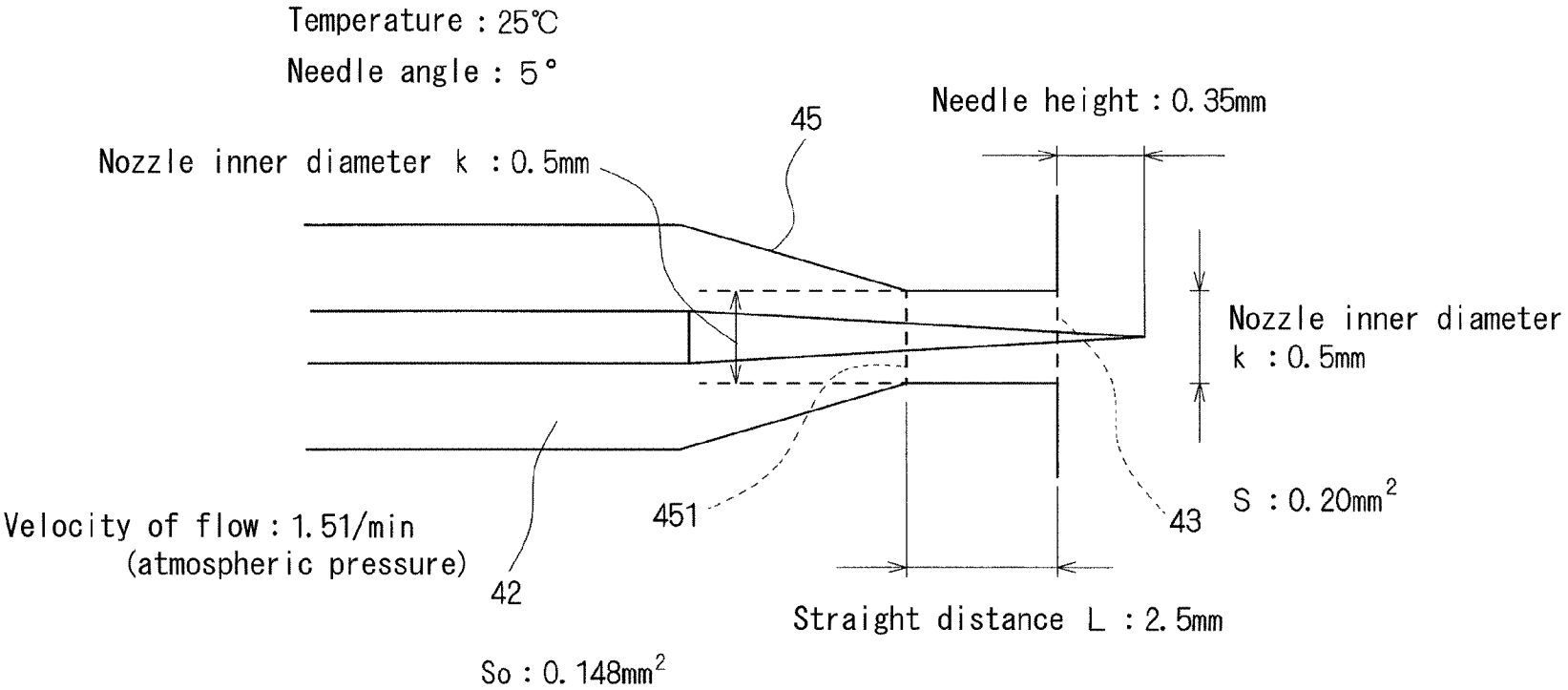
FIG. 12 schematically shows dimensions and the like of the pressure evaluating nozzle.

The pressure evaluating nozzle 114 also includes an emission port pressure measuring hole 51 which is a hole for measuring a gas pressure at the emission port 43, a stagnation point pressure measuring hole 52 which is a hole for measuring a gas pressure at a stagnation point, and a needle cap outlet 53. Herein, the gas pressures at the respective portions were measured using a pressure sensor. The stagnation point pressure refers to a gas pressure at a position where a channel area of the gas channel 42 does not vary, the position being located forward of the throat part 45. FIG. 12 schematically shows dimensions and the like of the pressure evaluating nozzle 114.

In FIG. 12, a reference symbol S represents a channel area at the emission port 43, and this channel area S is obtained by subtracting a sectional area of the discharge electrode 41 from an opening area of the emission port 43. A reference symbol So represents a channel area at the throat surface 451, and this channel area So does not include the sectional area of the discharge electrode 41. A needle angle denotes a vertex of a conical tip of the discharge electrode 41 for ejecting ions. A needle height denotes a length of the tip of the discharge electrode 41 protruding from the emission port 43. A nozzle inner diameter k refers to an inner diameter of the emission port 43. A straight distance L refers to a distance from the throat surface 451 to the emission port 43.

Figure 13:
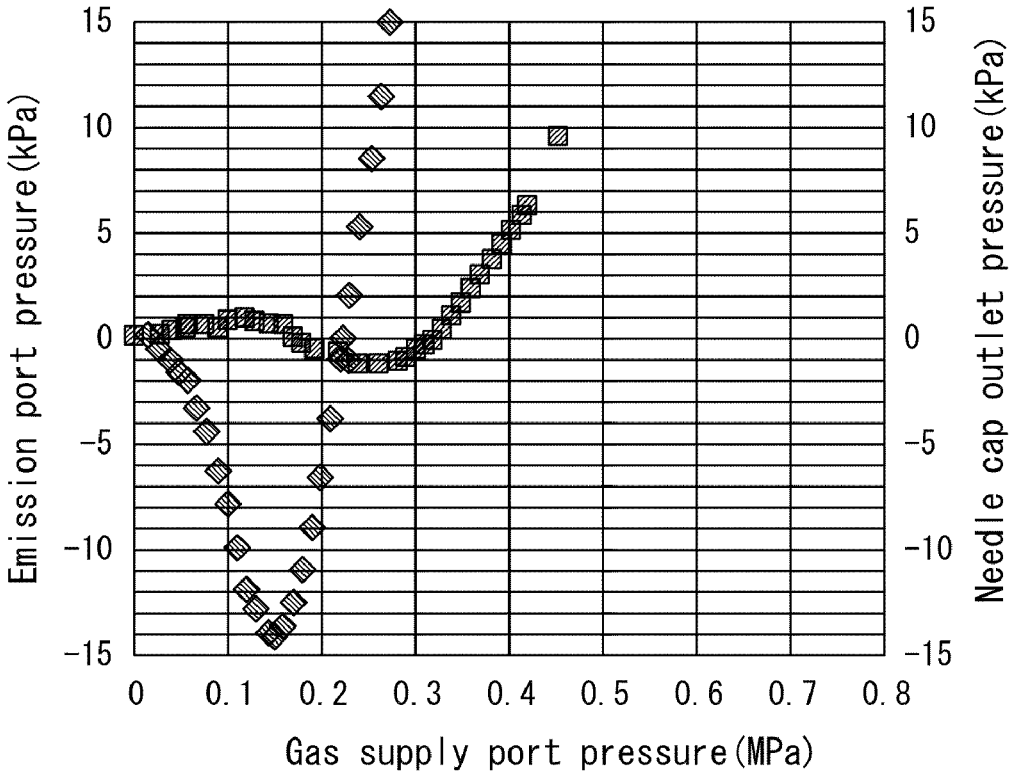
FIG. 13 shows a graph of a relation between a gas pressure at a gas supply port and a gas pressure at an emission port or a gas pressure at a needle cap outlet, each pressure being measured using the pressure evaluating nozzle.

FIG. 13 shows a graph of a relation between the gas pressure at the gas supply port 44 and the gas pressure at the emission port 43 or the gas pressure at the needle cap outlet 53, each pressure being measured using the pressure evaluating nozzle 114. More specifically, FIG. 13 shows a result of measurement of a pressure of gas supplied from the gas supply port 44 (a gas supply port pressure) using the pressure evaluating nozzle 114 shown in FIG. 11 while changing the gas supply port pressure. In FIG. 13, a black rhombus mark represents the relation between the emission port pressure and the gas supply port pressure. A black square mark represents the relation between the needle cap outlet pressure and the gas supply port pressure. Each of the emission port pressure and the needle cap outlet pressure is shown by a gauge pressure. The gauge pressure is a relative value to the atmospheric pressure (i.e., a difference with the atmospheric pressure). The gauge pressure having a value of 0 is equal to the atmospheric pressure. Moreover, the gauge pressure having a negative value is lower than the atmospheric pressure. On the other hand, the gauge pressure having a positive value is higher than the atmospheric pressure.

As shown in FIG. 13, at the gas supply port pressure of 0 (zero), no gas is supplied to the gas supply port 44; therefore, the emission port pressure is equal to the atmospheric pressure. At the gas supply port pressure of 0.17 MPa, the emission port pressure is −15 kPa which is lower than the atmospheric pressure. For this reason, it can be determined that the gas is emitted in the over expansion status. When the gas supply port pressure rises, the stagnation point pressure also rises proportionally (not shown). However, each of the emission port pressure and the needle cap outlet pressure is lower than the atmospheric pressure. For this reason, it can be determined that the gas is emitted in the over expansion status. Herein, it can be understood that ambient air is included in the gas. When the gas supply port pressure further rises, each of the emission port pressure and the needle cap outlet pressure starts to gradually rise. The emission port pressure becomes 0 (zero) at the gas supply port pressure of 0.22 MPa whereas the needle cap outlet pressure becomes 0 (zero) at the gas supply port pressure of 0.32 MPa. That is, each of the emission port pressure and the needle cap outlet pressure becomes equal to the atmospheric pressure. For this reason, it can be determined that the gas is emitted in the optimum expansion status. Thereafter, the respective pressures become higher than the atmospheric pressure. For this reason, it can be determined that the gas is emitted in the under expansion status. Herein, it can be understood that no ambient air is included in the gas.

FIG. 14 shows a table of a result of evaluation on an amount of foreign matters attached to the discharge electrode 41 in a case where the ionizer 1 according to the first embodiment is in the respective expansion statuses in which the velocity of flow of the gas is not more than and exceeds the velocity of sound. On evaluation conditions that a diameter of the emission port 43 is 0.4 mm, a voltage to be applied is ±7 kV, a frequency is 33 Hz, and purge air as a purifying gas is $N_2$, the ionizer 1 was operated continuously over a predetermined period of time in a foreign matter atmosphere in a predetermined concentration.

As shown in FIG. 14, when the $N_2$ gas was supplied at the gas supply port pressure of 0.02 MPa, the velocity of flow of the gas was 129 m/s which is not more than the velocity of sound. As a result, although an amount of flow of the gas was 1.5 L/min which is a minimum amount, the foreign matters in a very large amount were attached to the discharge electrode 41. On the other hand, when the $N_2$ gas was supplied at the gas supply port pressure of 0.17 MPa, the gas was emitted in the over expansion status in which the velocity of flow of the gas is about M1.1 which exceeds the velocity of sound. As a result, the amount of flow of the gas was 3.8 L/min, and the foreign matters in a small amount were attached to the discharge electrode 41.

As shown in FIG. 14, moreover, when the $N_2$ gas was supplied at the gas supply port pressure of 0.25 MPa, the gas was emitted in the optimum expansion status in which the velocity of flow of the gas is M1.2 which exceeds the velocity of sound. Herein, the amount of flow of the gas was 5 L/min and the foreign matters in a slight amount were attached to the discharge electrode 41. On the other hand, when the $N_2$ gas was supplied at the gas supply port pressure of 0.325 MPa, the gas was emitted in the under expansion status in which the velocity of flow of the gas is M1.2 to M1.5 which exceeds the velocity of sound. Herein, the amount of flow of the gas was 6 L/min and the foreign matters in an extremely slight amount were attached to the discharge electrode 41. Further, when the $N_2$ gas was supplied at the increased gas supply port pressure of 0.4 MPa, the gas was emitted in the under expansion status in which the velocity of flow of the gas is M1.7 which exceeds the velocity of sound. Herein, the amount of flow of the gas was 7.1 L/min and almost no foreign matters were attached to the discharge electrode 41.

Accordingly, the following fact was revealed. That is, if the velocity of flow of the gas exceeds the velocity of sound, although the amount of flow of the gas is larger than that in the case where the velocity of flow of the gas is not more than the velocity of sound, the amount of foreign matters attached to the discharge electrode 41 is reduced, so that almost no foreign matters are attached to the discharge electrode 41. Moreover, the following fact was also revealed. That is, even when the velocity of flow of the gas exceeds the velocity of sound, the foreign matters in a small amount are attached to the discharge electrode 41 in the over expansion status although the amount of flow of the gas is minimum. On the other hand, the following fact was also revealed. That is, the amount of foreign matters attached to the discharge electrode 41 is reduced in each of the optimum expansion status and the under expansion status, so that almost no foreign matters are attached to the discharge electrode 41. Even when the amount of flow of the gas increases, the amount of foreign matters attached to the discharge electrode 41 is reduced as the velocity of flow of the gas increases in the under expansion status, and almost no foreign matters are attached to the discharge electrode 41 when the velocity of flow of the gas reaches M1.7.

Figure 15A:
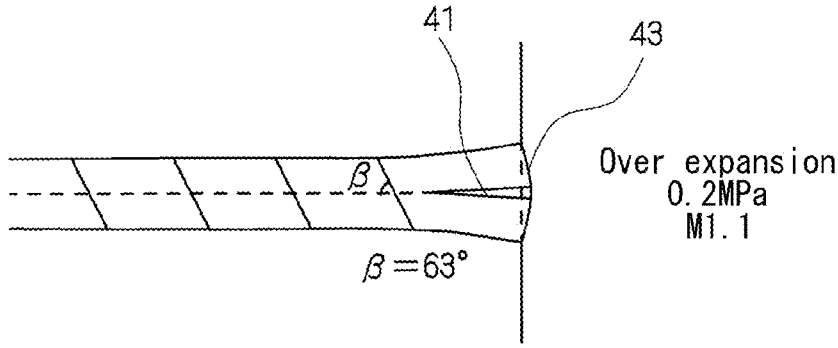
FIGS. 15A to 15D schematically show a flow of the gas emitted from the emission port at a velocity of flow exceeding the velocity of sound, the flow being observed using a differential interference microscope, respectively.
Figure 15B:
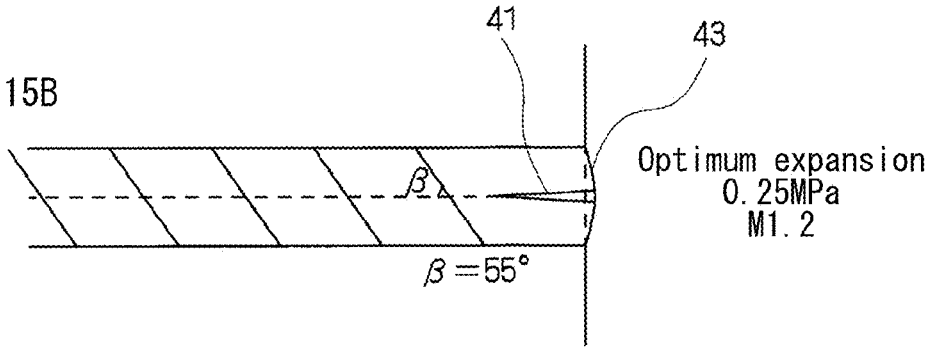
Figure 15C:
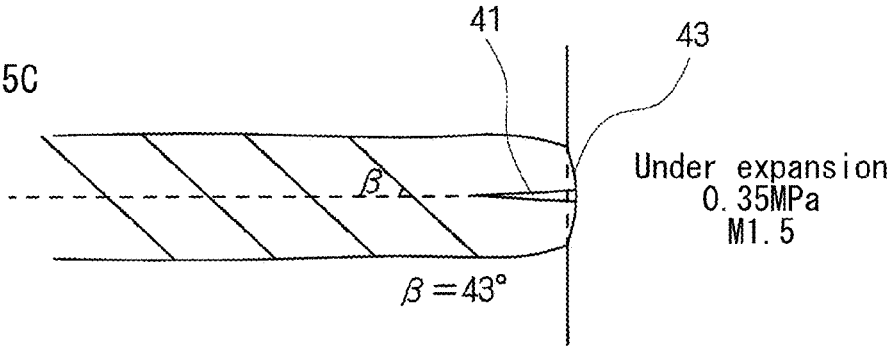
Figure 15D:
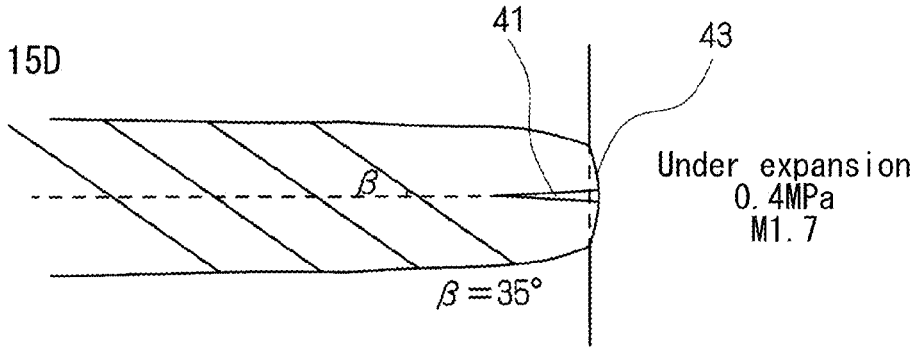

FIGS. 15A to 15D show schematic views of the visualized flow of the gas emitted from the emission port 43 at the velocity of flow exceeding the velocity of sound. Herein, FIG. 15A shows a case in the over expansion status in which the gas supply port pressure is 0.2 MPa and the velocity of flow of the gas is M1.1. FIG. 15B shows a case in the optimum expansion status in which the gas supply port pressure is 0.25 MPa and the velocity of flow of the gas is M1.2. FIG. 15C shows a case in the under expansion status in which the gas supply port pressure is 0.35 MPa and the velocity of flow of the gas is M1.5. FIG. 15D shows a case in the under expansion status in which the gas supply port pressure is 0.4 MPa and the velocity of flow of the gas is M1.7.

As shown in FIGS. 15A to 15D, even when the gas is emitted at the velocity of flow exceeding the velocity of sound in any of the over expansion status, the optimum expansion status and the under expansion status, there is observed a stripe pattern having a predetermined angle β relative to an axis of the discharge electrode 41. Herein, an axis direction of the discharge electrode 41 corresponds to a gas emitting direction; therefore, the angle β corresponds to an angle formed by the gas emitting direction. The predetermined angle β of the stripe pattern varies depending on the expansion status, and becomes smaller as the velocity of flow of the gas increases. As shown in FIG. 15A, in the over expansion status in which the velocity of flow of the gas is M1.1, the angle β is 63°. As shown in FIG. 15B, in the optimum expansion status in which the velocity of flow of the gas is M1.2, the angle β is 55°. As shown in FIG. 15C, in the under expansion status in which the velocity of flow of the gas is M1.5, the angle β is 43°. As shown in FIG. 15D, in the under expansion status in which the velocity of flow of the gas is M1.7, the angle β is 35°. This angle β is an index for measuring a Mach number which is calculated from 1/sin β.

Figure 16A:
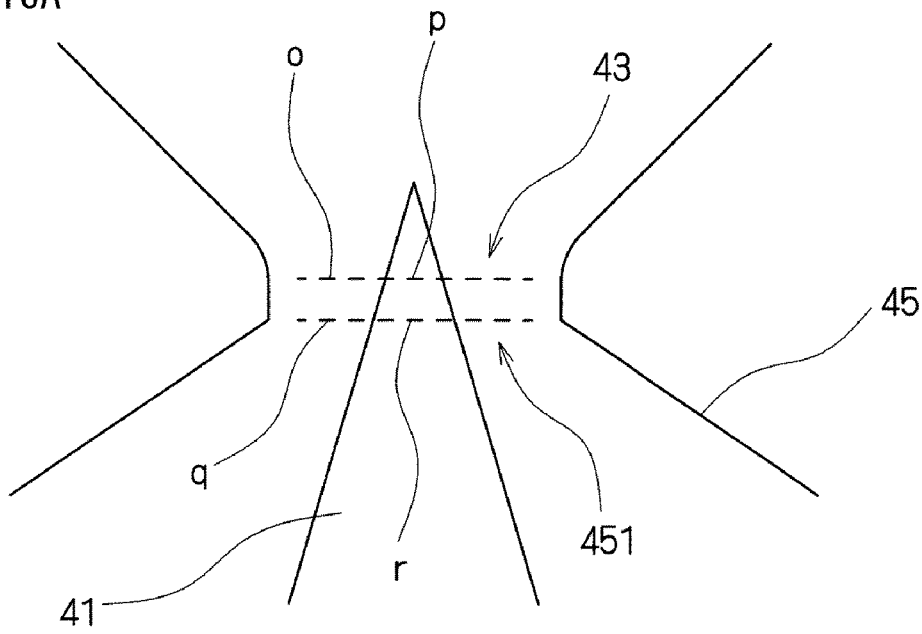
FIGS. 16A to 16C show schematic views for describing a relation in area between the emission port and a throat surface in the nozzle according to the first embodiment.
Figure 16B:
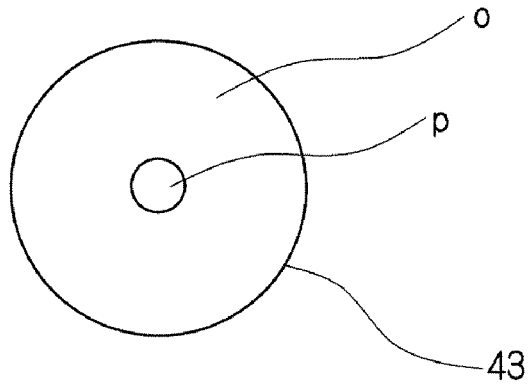
Figure 16C:
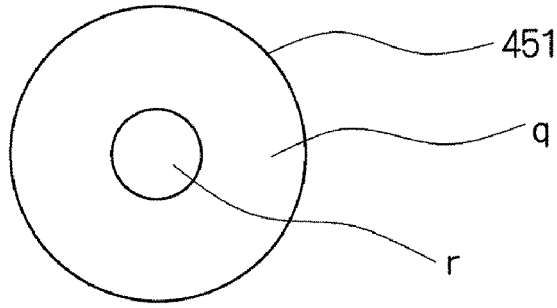

In the ionizer 1 according to the first embodiment, the discharge electrode 41 has the conical tip and induces corona discharge at the conical tip, and the throat part 45 has the throat surface 451 where the channel area is minimized. The ratio between the channel area at the throat surface 451 and the channel area at the emission port 43 is adjusted while the position of the discharge electrode 41 is changed. FIGS. 16A to 16C show schematic views for describing the relation in area between the emission port 43 and the throat surface 451 in the nozzle 4 according to the first embodiment. Specifically, FIG. 16A schematically shows the emission port 43, the throat part 45, the throat surface 451 and the discharge electrode 41 each of which is shown in FIG. 7, FIG. 16B schematically shows the opening surface of the emission port 43, and FIG. 16C schematically shows the throat surface 451.

As shown in FIG. 16A, the opening area of the emission port 43 and the area of the throat surface 451 are substantially equal to each other. Moreover, the discharge electrode 41 has the conical tip, and each of the opening surface of the emission port 43 and the throat surface 451 is arranged so as to be orthogonal to the axis of the discharge electrode 41. Further, the tip of the discharge electrode 41 is arranged at a position crossing the opening surface of the emission port 43 and the throat surface 451, and the emission port 43 is provided near the tip of the discharge electrode 41 with respect to the throat surface 451. As shown in FIGS. 16A and 16B, the channel area o of the emission port 43 corresponds to an area obtained by subtracting a sectional area p at the position of the emission port 43 of the discharge electrode 41 from the opening area of the emission port 43. Moreover, the channel area q of the throat surface 451 corresponds to an area obtained by subtracting a sectional area r at the position of the throat surface 451 of the discharge electrode 41 from the area of the throat surface 451. Accordingly, the channel area o of the emission port 43 is larger than the channel area q of the throat surface 451.

FIGS. 17A to 17D exemplarily show four nozzles having emission ports 43 which are different in diameter from one another, for use in the ionizer 1 according to the first embodiment. In the nozzle shown in FIG. 17A, the emission port 43 has an inner diameter of 0.9 mm. In the nozzle shown in FIG. 17B, the emission port 43 has an inner diameter of 1 mm. In the nozzle shown in FIG. 17C, the emission port 43 has an inner diameter of 0.86 mm. In the nozzle shown in FIG. 17D, the emission port 43 has an inner diameter of 0.4 mm. In FIGS. 17A to 17D, a reference symbol Po represents a so-called stagnation point pressure corresponding to the gas pressure at the position where the channel area does not vary, the position being located forward of the throat part 45. On the other hand, a reference symbol Pe represents the gas pressure at the emission port 43. Each of the gas pressures Po and Pe is shown by a gauge pressure; therefore, a relationship of Pe/Po takes a value obtained by conversion to a pressure to which a value of the atmospheric pressure is added. Further, a reference symbol S represents a channel area at the emission port 43, and this channel area S is obtained by subtracting the sectional area of the discharge electrode 41 from the opening area of the emission port 43. A reference symbol So represents the channel area at the throat surface 451, and this channel area So does not include the sectional area of the discharge electrode 41.

A needle angle denotes a vertex of the conical tip of the discharge electrode 41 for ejecting ions. The needle angle in each of the nozzles shown in FIGS. 17A to 17C is 30° whereas the needle angle in the nozzle shown in FIG. 17D is 5°. A needle height denotes a length of the tip of the discharge electrode 41 protruding from the emission port 43. A nozzle inner diameter k refers to an inner diameter of the emission port 43. A straight distance L refers to a distance from the throat surface 451 to the emission port 43. Herein, the area of the throat surface 451 and the opening area of the emission port 43 are equal to each other, and a shape ranging from the throat surface 451 to the emission port 43 is a substantially cylindrical shape. In these nozzles, the channel area at the throat surface 451 and the channel area at the emission port 43 were adjusted by changes in needle height and straight distance L. A ratio of specific heat y was 1.4, and an atmospheric pressure Pa was 0.101 MPa.

Figure 18:
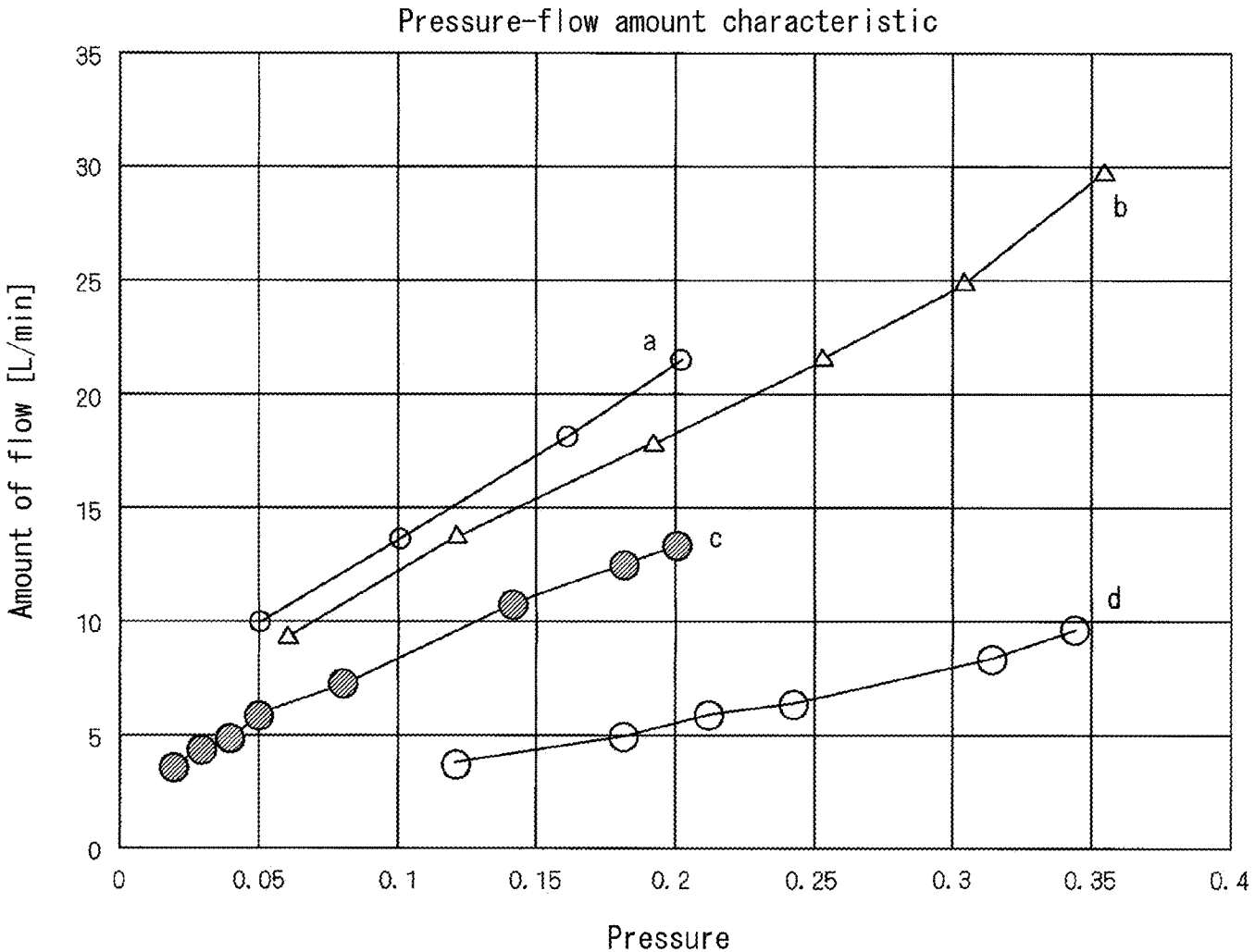
FIG. 18 shows a graph of a relation between an amount of gas to be supplied to each of the nozzles shown in FIGS. 17A to 17D and an amount of flow of the gas.

The channel area So at the throat surface 451 is 0.526 $mm^2$ in the nozzle a shown in FIG. 17A. The channel area So at the throat surface 451 is 0.487 $mm^2$ in the nozzle b shown in FIG. 17B. The channel area So at the throat surface 451 is 0.500 $mm^2$ in the nozzle c shown in FIG. 17C. The channel area So at the throat surface 451 is 0.122 $mm^2$ in the nozzle d shown in FIG. 17D. FIG. 18 shows a graph of a relation between an amount of gas to be supplied to each of the nozzles shown in FIGS. 17A to 17D and an amount of flow of the gas.

As shown in FIG. 18, the nozzle d shown in FIG. 17D was superior to the nozzles a, b and c shown in FIGS. 17A, 17B and 17C in the point that the amount of flow of the gas could be reduced because the channel area So at the throat surface 451 is minimized. Further, the nozzle d shown in FIG. 17D could suppress the increase in amount of flow of the gas due to the increase of the gas supply pressure.

FIGS. 19A to 19D show tables of the pressures, rates, areas and the like of the respective nozzles shown in FIGS. 17A to 17D in the optimum expansion status and the like. In other words, FIG. 19A shows the pressures and the like of the nozzle a shown in FIG. 17A, FIG. 19B shows the pressures and the like of the nozzle b shown in FIG. 17B, FIG. 19C shows the pressures and the like of the nozzle c shown in FIG. 17C, and FIG. 19D shows the pressures and the like of the nozzle d shown in FIG. 17D. FIGS. 20A to 20D show a table of the relation between the pressure and the rate in the respective expansion statuses, based on the pressure and the like shown in FIGS. 19A to 19D, respectively. In other words, FIGS. 20A to 20D correspond to the pressures and the like shown in FIGS. 19A to 19D.

As shown in FIGS. 19A to 19D and FIGS. 20A to 20D, in the optimum expansion status, the gas pressure Po at the stagnation point in the nozzle d shown in FIGS. 19D and 20D is 0.14 MPa which is a lowest value. The nozzle d having the smallest channel area So at the throat surface 451 is superior to the remaining nozzles in the following points. That is, the nozzle d can reduce the amount of flow of the gas and achieve the optimum expansion status at a lower pressure. In the optimum expansion status, the gas pressure Po in the nozzle a shown in FIGS. 19A and 20A and the gas pressure Po in the nozzle c shown in FIGS. 19C and 20C were 0.21 MPa and 0.23 MPa, respectively, which are relatively low. On the other hand, the gas pressure Po in the nozzle b shown in FIGS. 19B and 20B was 0.46 MPa, which is considerably high.

The channel area So at the throat surface 451 in the nozzle c is 0.500 $mm^2$ whereas the channel area So at the throat surface 451 in the nozzle a is 0.526 $mm^2$. That is, the nozzle c is smaller in channel area So than the nozzle a. On the other hand, the gas pressure Pe at the emission port 43 in the nozzle c is 0.08 MPa whereas the gas pressure Pe at the emission port 43 in the nozzle a is 0.09 MPa. That is, the nozzle c is smaller in gas pressure Pe than the nozzle a. The reason therefor is described below. The straight distance L from the throat surface 451 to the emission port 43 in the nozzle c is 0.3 mm whereas the straight distance L from the throat surface 451 to the emission port 43 in the nozzle a is 0.2 mm. That is, the nozzle c is longer in straight distance L than the nozzle a. Therefore, a channel area ratio of gas becomes distant from 1. Accordingly, it is preferable that the distance from the throat surface 451 to the emission port 43 is approximate to 0 (zero).

Moreover, the S/So in the nozzle d is 1.03, the S/So in the nozzle a is 1.10, the S/So in the nozzle c is 1.12, and the S/So in the nozzle b is 1.42. Further, the Mach number M in the nozzle d is 1.19, the Mach number M in the nozzle a is 1.38, the Mach number M in the nozzle c is 1.41, and the Mach number M in the nozzle b is 1.78. When the channel area ratio S/So between the channel area So at the throat surface 451 and the channel area S at the emission port 43 is 1, the gas is emitted in the optimum expansion status in which the Mach number M is 1. Therefore, as the channel area S at the emission port 43 becomes large with respect to the channel area So at the throat surface 451, the Mach number M for achieving the optimum expansion status becomes large. Accordingly, it is preferable that as the Mach number M for achieving the optimum expansion status is smaller, the amount of flow of the gas, which corresponds to an amount of gas per unit time, can be suppressed. It is also preferable that the channel area ratio S/So is approximate to 1.

Accordingly, the throat surface 451 is defined at the position near the emission port 43, so that the distance from the throat surface 451 to the emission port 43 is set at almost 0 (zero) and the ratio of the channel area at the emission port 43 to the channel area at the throat surface 451 is set at almost 1. Thus, only when the gas is supplied at a pressure of about 0.09 MPa, the gas can be emitted from the emission port 43 in the so-called optimum expansion status or under expansion status, leading to enhancement of the effect of preventing foreign matters from being attached to the tip of the discharge electrode 41 for ejecting ions. Herein, in the case where the emission port 43 serves as the throat surface 451 as shown in FIG. 10C, the distance from the throat surface 451 to the emission port 43 can be set at 0 (zero) and the ratio of the channel area at the emission port 43 to the channel area at the throat surface 451 can be set at 1.

Figure 21:
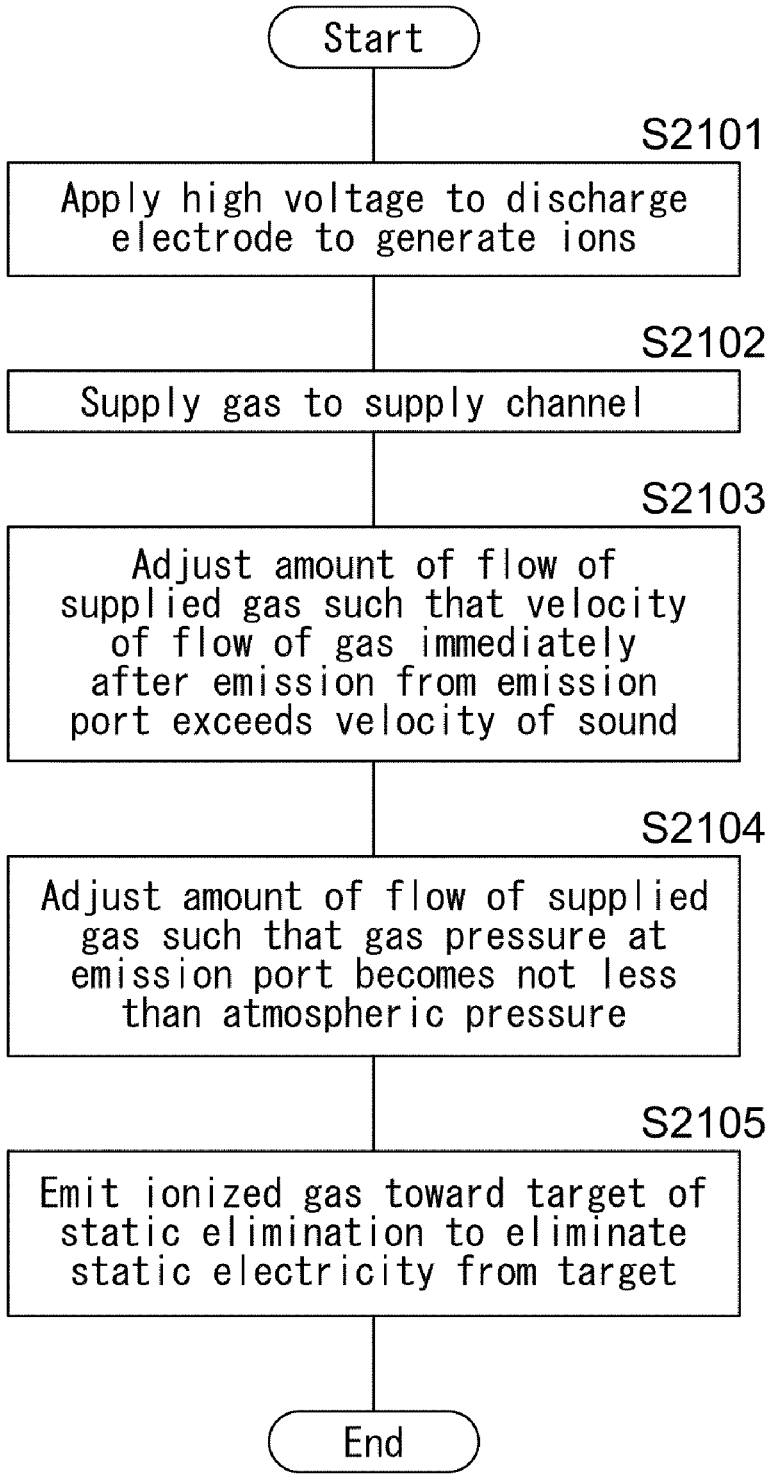
FIG. 21 shows a flowchart of a static elimination method using the ionizer according to the first embodiment.

Next, description will be given of a static elimination method using the bar-type ionizer 1 configured as described above, based on a flowchart. FIG. 21 shows the flowchart of the static elimination method using the ionizer 1 according to the first embodiment.

As shown in FIG. 21, the discharge electrodes 41 of the plurality of nozzles 4 provided on one longitudinal surface of the housing (main body casing) 2 of the bar-type ionizer 1 in the longitudinal direction of the housing at predetermined intervals are applied with high voltage to generate ions (step S2101). Specifically, voltage is applied to the discharge electrode 41 by, for example, the pulse AC method such that the discharge electrode 41 generates positive ions and negative ions alternately.

Next, gas is supplied from an external gas supply pipe connected to the ionizer 1 to the gas channel 42 in the nozzle 4 via the main gas supply passage 31 formed inside the main body casing 2 of the bar-type ionizer 1 in the longitudinal direction of the ionizer 1 (step S2102).

Next, an amount of flow of the supplied gas is adjusted such that a velocity of flow of gas immediately after emission from the emission port 43 of the nozzle 4 exceeds the velocity of sound (step S2103). Next, the amount of flow of the supplied gas is adjusted such that a gas pressure at the emission port 43 is not less than the atmospheric pressure (step S2104). Thus, ionized gas can be emitted from the emission port 43 in either the optimum expansion status or the under expansion status. In the optimum expansion status or the under expansion status, the ionized gas is emitted toward a target of static elimination to eliminate static electricity from the target (step S2105).

According to the first embodiment, as described above, the gas supplied to the gas channel 42 is ionized using the ions ejected from the discharge electrode 41, and the ionized gas is emitted from the emission port 43. Herein, the velocity of flow of the gas immediately after emission from the emission port 43 exceeds the velocity of sound, and the gas pressure at the emission port 43 is not less than the atmospheric pressure. Therefore, the gas can be emitted from the emission port 43 in the so-called optimum expansion status or under expansion status. Thus, it is possible to prevent the foreign matters from being attached to the tip of the discharge electrode 41 for ejecting ions, to rapidly bring the satisfactory amount of ionized gas into contact with the target of static elimination, and to attain the satisfactory static elimination effect at the high static elimination rate. Moreover, the gas channel 42 includes the throat part 45 for narrowing the gas channel 42 such that the channel area gradually decreases. Herein, the ratio of the atmospheric pressure to the gas pressure at the position where the gas channel area does not vary, the position being located forward of the throat part 45, is not more than 0.528. Therefore, the velocity of flow of the gas immediately after emission from the emission port 43 exceeds the velocity of sound, and the gas pressure at the emission port 43 becomes not less than the atmospheric pressure. Thus, it is possible to set the optimum emission status or the under expansion status.

Second Embodiment

Figure 22B:
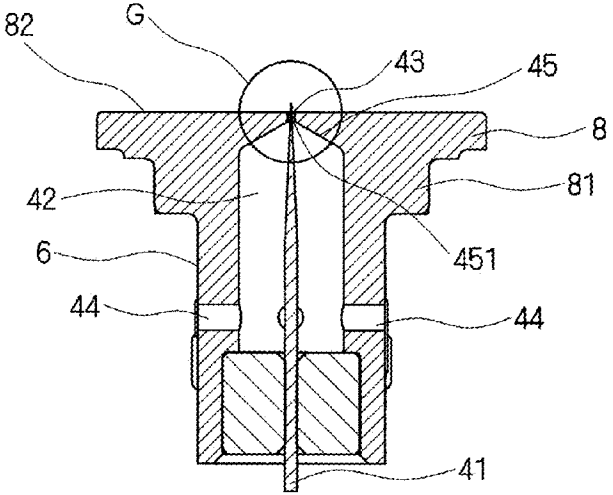
FIGS. 22A, 22B and 22C show a perspective view, a sectional view and an enlarged view of a nozzle of an ionizer according to a second embodiment of the present invention.
Figure 22C:
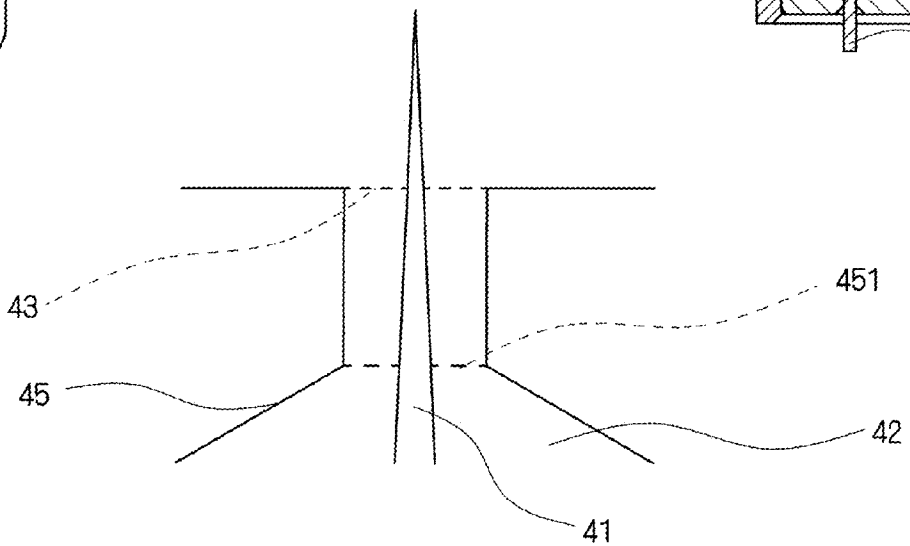
Figure 22A:
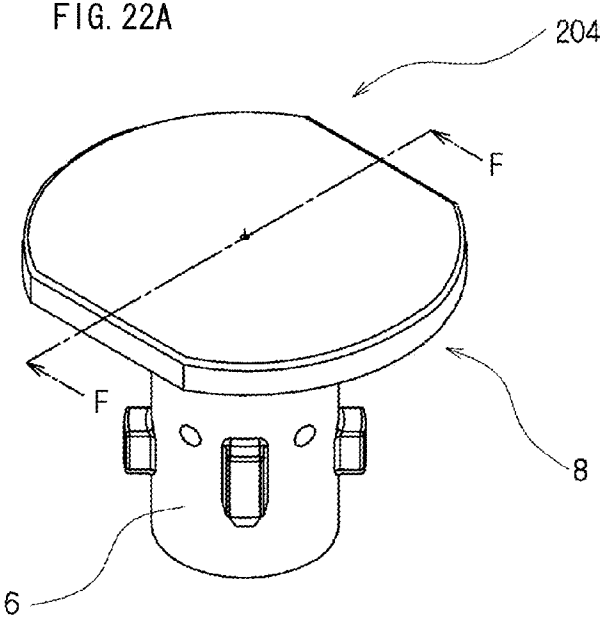

An ionizer 1 according to a second embodiment of the present invention is similar in configuration to the ionizer 1 according to the first embodiment. Therefore, elements having identical or similar configurations or functions are denoted by identical or similar reference symbols, and detailed description thereof will not be given here. In the second embodiment, a nozzle 204 is different in shape from the nozzle 4 according to the first embodiment. FIG. 22A shows a perspective view of the nozzle 204 of the ionizer 1 according to the second embodiment. FIG. 22B shows a sectional view taken along a line F-F in the perspective view shown in FIG. 22A. FIG. 22C shows an enlarged view of a portion G shown in FIG. 22B.

As shown in FIGS. 22A to 22C, the nozzle 204 according to the second embodiment includes a discharge electrode 41, a gas channel 42, an emission port 43, a gas supply port 44, and a throat part 45 serving as a throat surface 451. These components are similar in functions to those in the first embodiment. Herein, the nozzle 204 according to the second embodiment is different from the nozzle 4 according to the first embodiment in the shape near the emission port 43. As shown in FIGS. 22B and 22C, the nozzle 204 is configured with a tube-shaped portion 6 and a disc-shaped portion 8, as in the nozzle 4. Herein, the disc-shaped portion 8 has an outer diameter which is almost twice as large as an outer diameter of the tube-shaped portion 6. A tube-shaped projection 81 is formed on the disc-shaped portion 8 at a position beside the tube-shaped portion 6 and serves as a portion by which the nozzle 204 is fastened to a main body casing 2. The tube-shaped projection 81 has an outer diameter which is substantially intermediate between the outer diameter of the disc-shaped portion 8 and the outer diameter of the tube-shaped portion 6. However, the nozzle 204 is different from the nozzle 4 in the point that the disc-shaped portion 8 has a flat surface 82 which is substantially orthogonal to the discharge electrode 41 and is flush with an opening surface of the emission port 43. Gas is emitted from the emission port 43 of the nozzle 204 at a velocity of flow exceeding a velocity of sound.

In the nozzle 4 according to the first embodiment, on the other hand, the disc-shaped portion 7 has a surface from which ions are ejected, and this surface is not flat, that is, a peripheral portion 72 of the emission port 43 protrudes in the ion ejecting direction as shown in FIG. 4. Therefore, the surface, which includes the peripheral portion 72 and from which ions are ejected, of the disc-shaped portion 7 of the nozzle 4 is located forward of the opening surface of the emission port 43 in the ion ejecting direction. However, the gas emitted from the emission port 43 of the nozzle 4 at the velocity of flow exceeding the velocity of sound is emitted from the emission port 43 without flowing along the peripheral portion 72 of the nozzle 4.

Figure 23A:
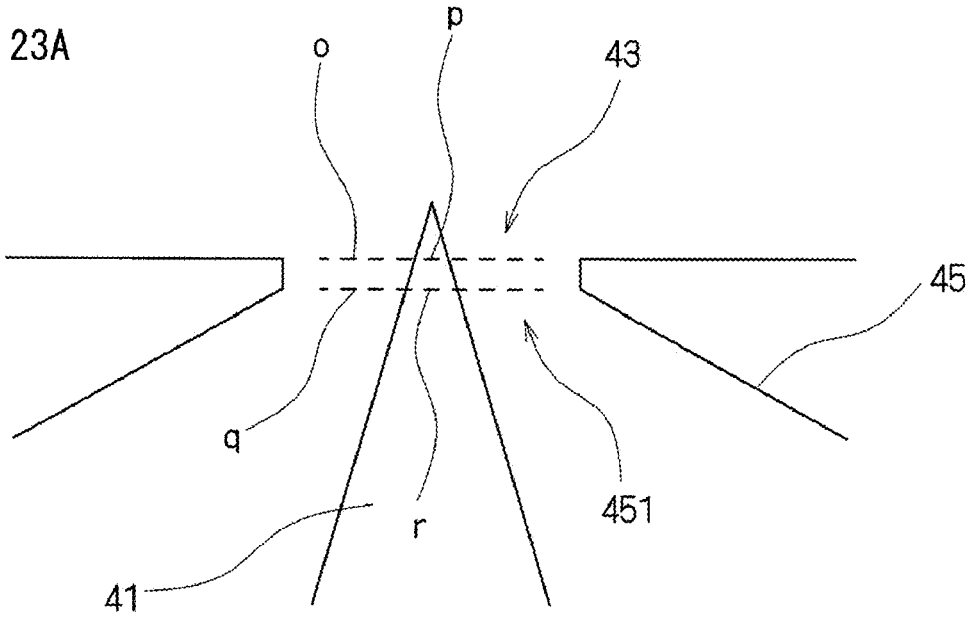
FIGS. 23A to 23C show schematic views for describing a relation in area between an emission port and a throat surface in the nozzle according to the second embodiment.
Figure 23B:
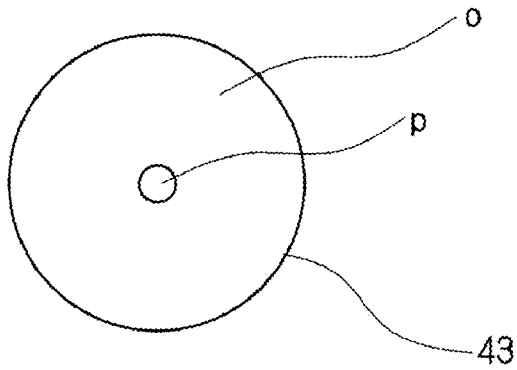
Figure 23C:
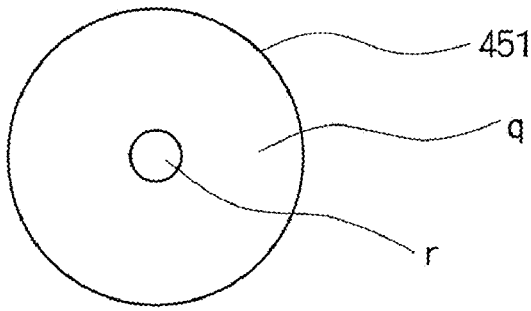

FIGS. 23A to 23C show schematic views for describing the relation in area between the emission port 43 and the throat surface 451 in the nozzle 204 according to the second embodiment. Specifically, FIG. 23A schematically shows the emission port 43, the throat part 45, the throat surface 451 and the discharge electrode 41 each of which is shown in FIG. 22C, FIG. 23B schematically shows the opening surface of the emission port 43, and FIG. 23C schematically shows the throat surface 451.

As shown in FIG. 23A, the opening area of the emission port 43 is substantially equal to the area of the throat surface 451. Moreover, the discharge electrode 41 has a conical tip, and each of the opening surface of the emission port 43 and the throat surface 451 is arranged so as to be orthogonal to an axis of the discharge electrode 41. Further, the tip of the discharge electrode 41 is arranged at a position crossing the opening surface of the emission port 43 and the throat surface 451, and the emission port 43 is provided near the tip of the discharge electrode 41 with respect to the throat surface 451. As shown in FIGS. 23A and 23B, the channel area o of the emission port 43 corresponds to an area obtained by subtracting a sectional area p at the position of the emission port 43 of the discharge electrode 41 from the opening area of the emission port 43. Moreover, the channel area q of the throat surface 451 corresponds to an area obtained by subtracting a sectional area r at the position of the throat surface 451 of the discharge electrode 41 from the area of the throat surface 451. Accordingly, the channel area o of the emission port 43 is larger than the channel area q of the throat surface 451.

The shape near the emission port 43 of the nozzle 204 according to the second embodiment shown in FIG. 23A is different from the shape near the emission port 43 of the nozzle 4 according to the first embodiment shown in FIG. 16A. As shown in FIG. 23B and FIG. 16B, however, the nozzle 204 and the nozzle 4 are identical with each other in the relation between the channel area at the emission port 43 and the channel area at the throat surface 451.

As described above, the nozzle 204 according to the second embodiment is different from the nozzle 4 according to the first embodiment in the shape near the emission port 43. However, this difference in shape exerts no influence on the gas to be emitted from the emission port 43 at the velocity of flow exceeding the velocity of sound. As described above, moreover, the nozzle 204 according to the second embodiment is identical with the nozzle 4 according to the first embodiment in the relation in area between the emission port 43 and the throat surface 451. Further, the nozzle 204 according to the second embodiment is similar to the nozzle 4 according to the first embodiment in the respective configurations except the emission port 43. Therefore, the nozzle 204 according to the second embodiment can produce effects similar to those produced by the nozzle 4 according to the first embodiment, on conditions such as a dimension, a gas pressure, an amount of flow, which are identical with those in the first embodiment.

According to the second embodiment, as described above, the gas supplied to the gas channel 42 is ionized using the ions ejected from the discharge electrode 41, and the ionized gas is emitted from the emission port 43. Herein, the velocity of flow of the gas immediately after emission from the emission port 43 exceeds the velocity of sound, and the gas pressure at the emission port 43 is not less than the atmospheric pressure. Therefore, the gas can be emitted from the emission port 43 in the so-called optimum expansion status or under expansion status. Thus, it is possible to prevent foreign matters from being attached to the tip of the discharge electrode 41 for ejecting ions, to rapidly bring the satisfactory amount of ionized gas into contact with a target of static elimination, and to attain a satisfactory static elimination effect at a high static elimination rate. Moreover, the gas channel 42 includes the throat part 45 for narrowing the gas channel 42 such that the gas channel area gradually decreases. Herein, the ratio of the atmospheric pressure to the gas pressure at the position where the channel area of the gas channel 42 does not vary, the position being located forward of the throat part 45, is not more than 0.528. Therefore, the velocity of flow of the gas immediately after emission from the emission port 43 exceeds the velocity of sound, and the gas pressure at the emission port 43 becomes not less than the atmospheric pressure. Thus, it is possible to set the optimum emission status or the under expansion status.

As described above, each of the ionizer according to the first embodiment and the ionizer according to the second embodiment is a bar-type ionizer including a plurality of nozzles provided on one longitudinal surface of a housing. However, the ionizer according to the present invention is not limited to the bar-type ionizer. For example, the ionizer according to the present invention may be a gun-type ionizer including one nozzle, thereby eliminating static electricity from a relatively small range. This gun-type ionizer can produce effects similar to those produced by the bar-type ionizer.

Moreover, the ionizer according to the present invention can employ all the voltage application methods including the pulse AC method, the DC method, the AC method, the high-frequency AC method, the pulse DC method and the like. Thus, the ionizer according to the present invention can produce a similar effect of preventing foreign matters from being attached to the discharge electrode and a satisfactory static elimination effect at a high static elimination rate, depending on the voltage application method to be employed.

In addition, the present invention is not limited to the first and second embodiments described above. It is needless to say that various modifications, substitutions and the like can be made within the scope of the gist of the present invention.

What is claimed is:

1. An ionizer comprising a nozzle including a discharge electrode for inducing corona discharge by application of high voltage to eject ions, an emission port for emitting supplied gas together with the ejected ions, and a gas channel for guiding supplied gas to the emission port, wherein a velocity of flow of the gas immediately after emission from the emission port exceeds a velocity of sound, and a gas pressure at the emission port is not less than an atmospheric pressure, wherein the gas channel has a throat part for narrowing the gas channel such that a channel area gradually decreases, and said throat part has a throat surface and said gas channel has a chamber formed forward of the throat surface, wherein a ratio of atmospheric pressure to gas pressure at a position where the channel area does not vary, the position being located forward of the throat part, is not more than 0.528, and has a channel area ratio S/So between channel area So at the throat surface and channel area S at the emission port of not more than 1.42 and a distance from the throat surface to the emission port is 0.5 mm or less.

2. The ionizer according to claim 1, wherein the discharge electrode is provided at a center of the nozzle, and the gas channel is formed to surround the discharge electrode.

3. The ionizer according to claim 2, further comprising a gas supply port for supplying gas to the gas channel, wherein the gas is narrowed down at the gas supply port.

4. The ionizer according to claim 1, wherein the channel area is minimized at the emission port.

5. A static elimination method for, by use of a bar-type ionizer including a plurality of nozzles each having a discharge electrode, the nozzles being provided on one longitudinal surface of a housing in a longitudinal direction of the housing at predetermined intervals, emitting ionized gas obtained by ionizing gas supplied to the nozzle from a gas channel in gas communication with the emission port toward a target of static elimination, the static elimination method comprising: applying positive or negative high voltage to the discharge electrode to generate ions at a periphery of a tip of the discharge electrode; and supplying the gas such that a velocity of flow of the gas immediately after emission from the emission port exceeds a velocity of sound and a gas pressure at the emission port is not less than an atmospheric pressure, wherein the gas channel has a throat part for narrowing the gas channel such that a channel area gradually decreases, and said throat part has a throat surface and said gas channel has a chamber formed forward of the throat surface, wherein a ratio of atmospheric pressure to gas pressure at a position where the channel area does not vary, the position being located forward of the throat part, is not more than 0.528, and has a channel area ratio S/So between channel area So at the throat surface and channel area S at the emission port of not more than 1.42 and a distance from the throat surface to the emission port is 0.5 mm or less.

* * * * *